US010907239B1

(12) United States Patent
Fang et al.

(10) Patent No.: US 10,907,239 B1
(45) Date of Patent: Feb. 2, 2021

(54) METHODS OF PRODUCING A TITANIUM ALLOY PRODUCT

(71) Applicant: University of Utah Research Foundation, Salt Lake City, UT (US)

(72) Inventors: Zhigang Zak Fang, Salt Lake City, UT (US); Yang Xia, Salt Lake City, UT (US); Pei Sun, Salt Lake City, UT (US); Ying Zhang, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 0 days.

(21) Appl. No.: 16/820,413

(22) Filed: Mar. 16, 2020

(51) Int. Cl.

| | |
|---|---|
| ***C22F 1/18*** | (2006.01) |
| ***C22C 1/04*** | (2006.01) |
| ***C22C 14/00*** | (2006.01) |
| ***B22F 9/22*** | (2006.01) |

(52) U.S. Cl.
CPC ..... *C22C 1/0458* (2013.01); *B22F 9/22* (2013.01); *C22C 14/00* (2013.01); *C22F 1/183* (2013.01); *B22F 2301/205* (2013.01)

(58) Field of Classification Search
CPC ..... B22F 9/22; B22F 2301/205; C22F 1/183; C22C 1/0458; C22C 14/00
See application file for complete search history.

(56) References Cited

U.S. PATENT DOCUMENTS

| | | | |
|---|---|---|---|
| 2,205,854 | A | 6/1940 | Kroll |
| 2,427,338 | A | 9/1947 | Alexander |
| 2,773,787 | A | 12/1956 | Rick |

(Continued)

FOREIGN PATENT DOCUMENTS

| | | | |
|---|---|---|---|
| CN | 101157990 | A | 4/2008 |
| CN | 101497945 | A | 8/2009 |

(Continued)

OTHER PUBLICATIONS

Zhang, Ying, et al. "Hydrogen assisted magnesiothermic reduction of TiO2." Chemical Engineering Journal 308 (2017): 299-310.*

(Continued)

*Primary Examiner* — Jessee R Roe
(74) *Attorney, Agent, or Firm* — Thorpe North & Western, LLP

(57) ABSTRACT

A method for producing a particulate titanium alloy product can include preparing a composite particulate oxide mixture with $TiO_2$ powder and at least one alloying element powder. The composite particulate oxide mixture can be co-reduced using a metallic reducing agent under a hydrogen atmosphere at a reduction temperature for a reduction time sufficient to produce a hydrogenated titanium alloy product. The hydrogenated titanium alloy product can then be heat treated under a hydrogen atmosphere and a heat treating temperature to reduce pore size and specific surface area to form a heat treated hydrogenated titanium product. The heat treated hydrogenated titanium product can be deoxygenated to reduce residual oxygen to less than 0.2 wt % to form a deoxygenated hydrogenated titanium product as a particulate. The deoxygenated hydrogenated titanium product can optionally be dehydrogenated to form the titanium alloy product as a particulate.

30 Claims, 15 Drawing Sheets

(56) References Cited

U.S. PATENT DOCUMENTS

| | | | |
|---|---|---|---|
| 2,804,375 | A | 8/1957 | Kamlet |
| 2,850,379 | A | 9/1958 | Hawkes |
| 2,984,560 | A | 5/1961 | Dombrowski |
| 3,140,170 | A | 7/1964 | Henrie et al. |
| 3,383,184 | A | 5/1968 | Kloepfer |
| 3,472,648 | A | 10/1969 | Suriani |
| 3,721,549 | A | 3/1973 | Gallay et al. |
| 3,829,309 | A | 8/1974 | Gomes et al. |
| 3,903,239 | A | 9/1975 | Berkovich |
| 4,923,531 | A | 5/1990 | Fisher |
| 5,102,452 | A | 4/1992 | Taskinen et al. |
| 5,211,775 | A | 5/1993 | Fisher et al. |
| 5,460,642 | A | 10/1995 | Leland |
| 5,503,655 | A | 4/1996 | Joseph |
| 5,779,761 | A | 7/1998 | Armstrong et al. |
| 5,830,420 | A | 11/1998 | Borowiec et al. |
| 6,126,712 | A | 10/2000 | Hohne et al. |
| 6,152,982 | A | 11/2000 | Froes et al. |
| 6,168,644 | B1 | 1/2001 | Fukasawa et al. |
| 6,231,636 | B1 | 5/2001 | Froes et al. |
| 6,264,719 | B1 | 7/2001 | Zhang et al. |
| 6,638,336 | B1 | 10/2003 | Drozdenko et al. |
| 7,559,969 | B2 | 7/2009 | Sanjurjo et al. |
| 7,585,457 | B2 | 9/2009 | Zhang et al. |
| 8,007,562 | B2 | 8/2011 | Kasparov et al. |
| 8,092,570 | B2 | 1/2012 | Boulos et al. |
| 8,328,899 | B2 | 12/2012 | Adam et al. |
| 8,388,727 | B2 | 3/2013 | Klevtsov et al. |
| 8,845,998 | B2 | 9/2014 | Ishikawa |
| 8,871,303 | B2 | 10/2014 | Han et al. |
| 9,067,264 | B2 | 6/2015 | Moxson et al. |
| 2001/0007646 | A1 | 7/2001 | Lakshmanan et al. |
| 2001/0019742 | A1 | 9/2001 | Itsukaichi et al. |
| 2003/0110890 | A1 | 6/2003 | He et al. |
| 2004/0103751 | A1 | 6/2004 | Joseph et al. |
| 2004/0194574 | A1 | 10/2004 | Cardarelli |
| 2005/0137078 | A1 | 6/2005 | Anderson et al. |
| 2005/0166706 | A1 | 8/2005 | Withers et al. |
| 2006/0011273 | A1 | 1/2006 | Zhang et al. |
| 2006/0174727 | A1 | 8/2006 | Bick et al. |
| 2006/0236811 | A1 | 10/2006 | Withers et al. |
| 2007/0110655 | A1 | 5/2007 | Xie et al. |
| 2007/0295167 | A1 | 12/2007 | Ogasawara et al. |
| 2008/0145687 | A1 | 6/2008 | Pretorius |
| 2008/0241026 | A1 | 10/2008 | Jha et al. |
| 2009/0311154 | A1 | 12/2009 | Jha et al. |
| 2010/0061925 | A1 | 3/2010 | Lee et al. |
| 2010/0064852 | A1 | 3/2010 | Zhang |
| 2011/0171116 | A1 | 7/2011 | Klevtsov et al. |
| 2012/0070578 | A1 | 3/2012 | Han et al. |
| 2012/0282469 | A1 | 11/2012 | Nahas |
| 2013/0220211 | A1 | 8/2013 | Dutta et al. |
| 2013/0315773 | A1 | 11/2013 | Moxson et al. |

FOREIGN PATENT DOCUMENTS

| | | | |
|---|---|---|---|
| CN | 101913878 | A | 12/2010 |
| DE | 974210 | C | 10/1960 |
| EP | 1777302 | A1 | 4/2007 |
| GB | 800689 | | 8/1958 |
| GB | 807889 | | 1/1959 |
| JP | S49-069585 | A | 7/1974 |
| JP | H01-192727 | A | 8/1989 |
| JP | H03-243732 | A | 10/1991 |
| JP | 2000219922 | A | 8/2000 |
| JP | 2009513819 | A | 4/2009 |
| JP | 2009518544 | A | 5/2009 |
| JP | 2012107337 | A | 6/2012 |
| JP | 2016528393 | A | 9/2016 |
| KR | 10-1259434 | B1 | 4/2013 |
| WO | WO 2007/097823 | A2 | 8/2007 |
| WO | WO 2010/036131 | | 4/2010 |
| WO | WO 2011/106804 | A1 | 9/2011 |
| WO | WO 2012/148471 | A1 | 11/2012 |
| WO | WO 2013/100963 | A1 | 7/2013 |
| WO | WO 2014/187867 | | 11/2014 |
| WO | WO 2015/050637 | | 4/2015 |
| WO | WO 2015175726 | A1 | 11/2015 |

OTHER PUBLICATIONS

Astrelin et al, "Interaction of TiHx (x>2) with solutions of some acids and alkalies." Hydrogen Materials Science and Chemistry of Metal Hydrides. 2002;82:133-40.

Baba et al.; "Tantalum and Niobium Powder Preparation from their Oxides by Calciothermic Reduction in the Molten $CaCl^2$;" Journal of Physics and Chemistry of Solids; (Feb.-Apr. 2005); pp. 466-470; vol. 66, Issues 2-4; <doi: 10.1016/j.jpcs.2004.06.042 >.

Barksdale, "Titanium: its occurrence, chemistry, and technology." 2nd ed. New York: Ronald Press Co.; 1966.

Bolivar et al, "Recycling, Synthesis of titanium via magnesiothermic reduction of TiO2 (Pigment)", Proceedings of EMC (2009) 1-17.

Chen et al, "Direct Electrochemical Reduction of Titanium Dioxide to Titanium in Molten Calcium Chloride." Nature. 2000;407:361-4.

Crowley, "A new process for titanium extraction and production promises to cut costs and expand applications", Advanced materials & processes (2003) 25-27.

Dupont™; "Ti-Pure® R-706 Titanium Dioxide"; Chemours; (2015); 3 pages; [retrieved on May 7, 2018]; Retrieved from <URL: https://web.archive.org/web/20151025112946/https://www.chemours.com/Titanium_Technologies/en_US/products/706/index.html.

Fang et al, "A new, energy-efficient chemical pathway for extracting Ti Metal from Ti minerals", JACS 135 (2013) 18248-18251.

Froes, "The production of low-cost titanium powders." JOM. 1998;50(September):41-3.

Froes, "Titanium powder metallurgy: a review—Part 1: titanium and its alloys are the materials of choice for many applications, but high cost often negates their use. Powder metallurgy offers a cost-effective fabrication approach", Advanced Materials & Processes 170.9, Sep. 2012, 6 pages, vol. 16, No. 7.

Gueguin, "Chemistry and mineralogy of titanium-rich slags. Part I-Hemo-ilmenite, sulphate, and upgtaded titania slags", Mineral Processing & Extractive Metall. Rev. 28 (2007) 1-58.

Hartman et al, "Producing lower-cost titanium for automotive applications", JOM 50 (1998) 16-19.

Hunter, "Metallic titanium", JACS 32 (1910) 330-336.

Kikuchi et al, "Rapid reduction of titanium dioxide nano-particles by reduction with a calcium reductant", J. Phys. Chem. Solids 75 (2014) 1041-1048.

Kroll, "The production of ductile titanium." Trans Met Soc AIME. 1959;215:546-53.

Lasheen, "Soda ash roasting of titania slag product from Rosetta ilmenite." Hydrometallurgy. 2008;93(3-4):124-8.

Lin, "The effect of alkali salt catalyst on the carbothermic reduction of nickel oxide." Metallurgical Transactions B. 1987;19B:685-6.

Middlemas et al, "A new method for production of titanium dioxide pigment", Hydrometallurgy 131 (2013) 107-113.

Middlemas, "Energy-conscious production of titania and titanium powders from slag", University of Utah, (2014).

Nersisyan et al, "Direct magnesiothermic reduction of titanium dioxide to titanium powder through combustion synthesis", Chem. Eng. J. 235 (2014) 67-74.

Oh et al, "Deoxidation of Ti powder and preparation of Ti ingot with low oxygen concentration", Mater. Trans. 53 (2012) 1075-1077.

Oh et al, "Preparation of low oxygen content alloy powder from Ti binary alloy scrap by hydrogenation-dehydrogenation and deoxidation process", J. Alloys Compd. 593 (2014) 61-66.

Okabe et al, "Titanium powder production by preform reduction process (PRP)", J. Alloys Compd. 364 (2004) 156-163.

Poor et al.; "Furnace Atmosphere for Heat Treating, Steel Heat Treating Technologies." vol. 4B, ASM Handbook, ASM international, 2013, pp. 108-134. (Year 2013).

Rao et al, "Catalysis by alkali carbonates of carbothermic reduction of magnetite concentrates." Ironmaking and Steelmaking. 1984;11(6):308-18.

(56) References Cited

OTHER PUBLICATIONS

Rittmeyer et al.; "Hydrides;" Ulmann's Encyclopedia of Industrial Chemistry; (2012); pp. 103-132; vol. 18; <doi: 10.1002/14356007.a13_199 >.
Supplementary European Search Report dated Jun. 25, 2019, in EP Application No. 17750888.4, filed Feb. 10, 2017; 3 pages.
Suzuki et al, "Calcium-deoxidation of niobium and titanium in Ca-saturated $CaCl_2$ molten salt", J. Alloys Compd. 288 (1999) 173-182.
Technologies E. Summary of Emerging Titanium Cost Reduction Technologies. Vancouver, WA2004. p. 12.
Vuuren et al, "Opportunities in the Electrowinning of Molten Titanium from Titanium Dioxide", JOM, Oct. 2005, 3 pages.
Won et al, "Titanium powder prepared by a rapid exothermic reaction", Chem. Eng. J. 157 (2010) 270-275.
Xu et al, "Behavior of calcium chloride in reduction process of titanium dioxide by calcium vapor", J. Alloys Compd. 576 (2013) 208-214.
Xue, "Production of Titanium Dioxide by Decomposition of Titanium Slag with Molten Sodium Hydroxide", Dalian University of Technology, (2009).
Xue et al.; "Decomposition Kinetics of Titanium Slag in Sodium Hydroxide System." Hydrometallurgy; Elsevier; Jan. 2009; vol. 95, Issues 1-2; pp. 22-27.
Zhang et al, "A literature review of titanium metallurgical processes", Hydrometallurgy 108 (2011) 177-188.
Zhang et al, "A novel preparation of titanium dioxide from titanium slag." Hydrometallurgy. 2009;96(1-2):52-6.
Zheng et al, "Production of titanium powder by the calciothermic reduction of titanium concentrates or ore using the preform reduction process", Mater. Trans. 48 (2007) 2244-2251.

* cited by examiner

METHODS OF PRODUCING A TITANIUM ALLOY PRODUCT

GOVERNMENT INTEREST

This invention was made with government support under grant no. DE-AR0000420 awarded by the Department of Energy. The government has certain rights in the invention.

BACKGROUND

Titanium is strong, light weight, corrosion resistant, and biocompatible. This unique combination of properties makes it a valuable natural resource well suited for numerous potential commercial applications. Titanium has been manufactured commercially since at least 1948 and is broadly used in the aerospace, medical, and military defense industries. For example, the U.S. Geological Survey, Mineral Industry Surveys on titanium, reports that approximately 67% of mill products and castings during 2011 were used in commercial and military aerospace applications. Yet, other industries where titanium would be useful still rely heavily upon general purpose steel. Heavy dependence on steel is not surprising because producing titanium by conventional methods can be twenty times more expensive than producing steel. Much of this high cost is due to the indirect nature of known processes, which are time-intensive and require high amounts of energy, such as carbothermal reduction processes and metallothermic reduction of titanium chloride such as the Kroll and Hunter processes. In more recent history, attempts to identify more economical methods of producing titanium include the Armstrong process, the FCC Cambridge electrolysis process, and the like.

In addition to these challenges, formation of titanium alloys presents unique challenges. For example, obtaining highly homogeneous alloys materials in large quantities can be very difficult. Typical titanium alloy production begins with subjecting a titanium sponge, which is often commercially pure titanium (CP—Ti), and master alloy (e.g. AIV) to a vacuum arc remelting (VAR) process. This process involves melting of an electrode in a copper crucible to produce a homogeneous mixture of the titanium sponge and master alloy. On a commercial scale, VAR processes also typically utilize 1 to 10 ton ingots in furnaces that are ten to twenty feet tall. In order to obtain high purity titanium alloys, the VAR process must be performed multiple times (e.g. 2-3 times) which involves cyclic loading and substantial energy input. Thus, there remains a need for a simplified and reduced cost method for the production of titanium metals and particularly titanium alloys.

SUMMARY

A solid state alloying process can be used to form titanium alloy powders alloyed with one or more elements such as Al, Mo, V, Nb, Ta, Fe, Cr, Mn, Co, Cu, W, Al, Zr, Sn, Ni, Si, and other elements. Generally, a method for producing a particulate titanium alloy product can include preparing a composite particulate oxide mixture with $TiO_2$ powder and at least one alloying element powder. The composite particulate oxide mixture can be co-reduced using a metallic reducing agent under preferably at least a partial hydrogen atmosphere at a reducing temperature for a reduction time sufficient to produce a hydrogenated titanium alloy product. The hydrogenated titanium alloy product can then be heat treated under a hydrogen atmosphere and a heat treating temperature to reduce pore size and specific surface area to form a heat treated hydrogenated titanium product. The heat treated hydrogenated titanium product can be deoxygenated to reduce residual oxygen to less than 0.3 wt % (or often <0.15%) to form a deoxygenated hydrogenated titanium product. The deoxygenated hydrogenated titanium product can optionally be dehydrogenated to form the titanium alloy product.

Notably, the deoxygenated hydrogenated titanium product and the titanium alloy product are a particulate.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
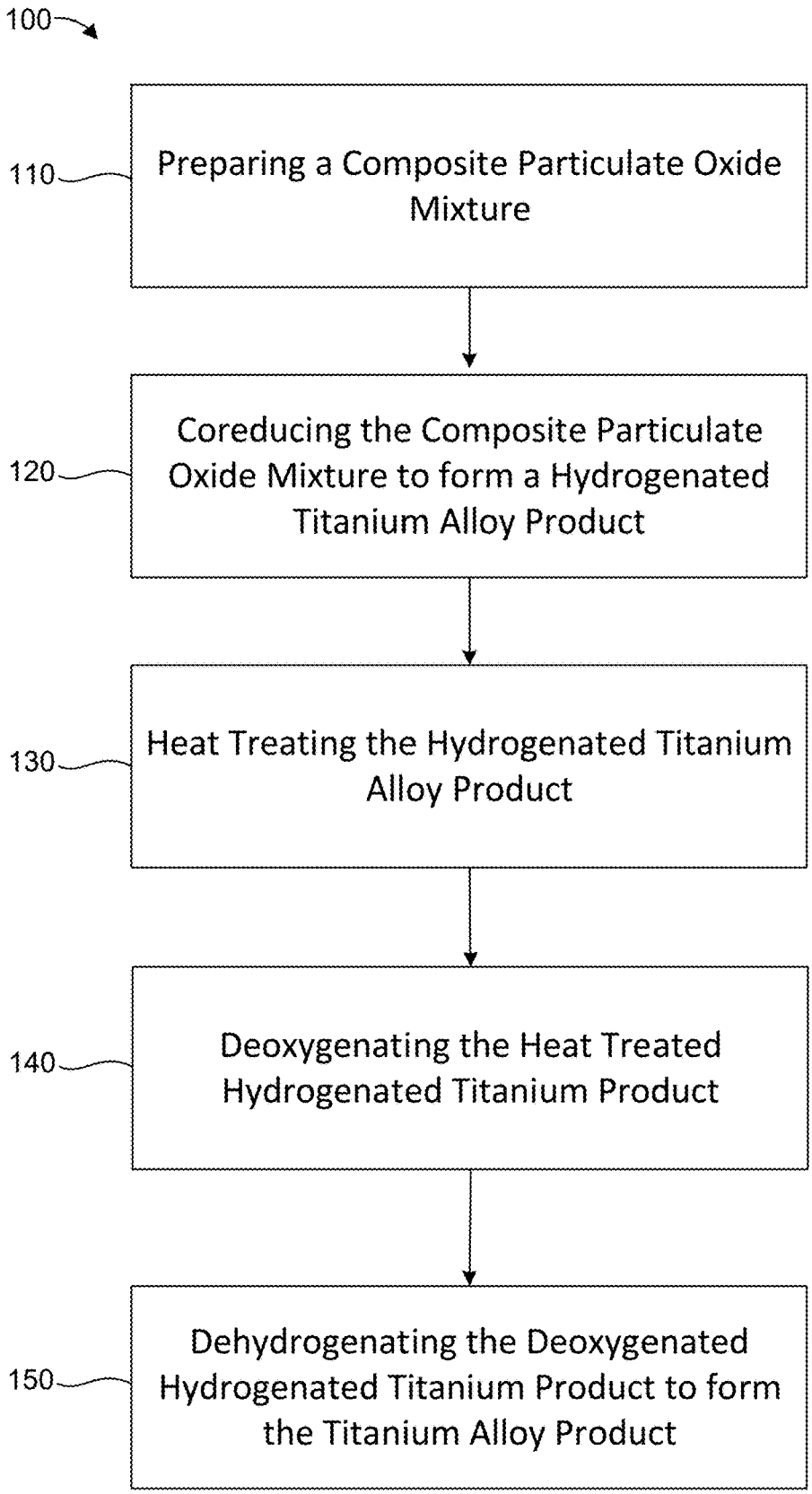
FIG. 1 is a process flow diagram illustrating the method of producing a particulate titanium alloy product.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "a reducing agent" includes reference to one or more of such materials and reference to "subjecting" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, "hydrogenated" products are those in which hydrogen is incorporated through either formation of hydride compounds, dissolved hydrogen, or a combination of both mechanisms. Dissolved hydrogen exists as an interstitial element within a metal crystal lattice. Ti with dissolved hydrogen is called a solid solution of Ti with hydrogen. In contrast, hydride compounds are those in which hydrogen is chemically bonded to a corresponding metal (e.g. titanium hydride or the like). A fully hydrogenated titanium is known as titanium hydride with the formula of $TiH_2$. However, titanium hydride may also have less than full hydrogenation, thus the formula may be written as $TiH_{2-x}$.

As used herein, "particulate" is intended to refer to small powder or particle products having a size of less than about 1 mm, and most often less than about 500 μm.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

As used herein, the term "at least one of" is intended to be synonymous with "one or more of" For example, "at least one of A, B and C" explicitly includes only A, only B, only C, or combinations of each.

As used herein, the term "about" is used to provide flexibility and imprecision associated with a given term, metric or value. The degree of flexibility for a particular variable can be readily determined by one skilled in the art. However, unless otherwise enunciated, the term "about" generally connotes flexibility of less than 2%, and most often less than 1%, and in some cases less than 0.01%. The recitation of a specific value also expressly discloses precisely that value such that "about 4" would also include "exactly 4." Furthermore, all percentages are weight percent unless otherwise indicated.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Referring generally to FIG. 1, a method 100 for producing a particulate titanium alloy product can include preparing 110 a composite particulate oxide mixture. The composite particulate oxide mixture can include $TiO_2$ powder and at least one alloying element powder. The method 100 can also include co-reducing 120 the composite particulate oxide mixture using a metallic reducing agent under a full or partial hydrogen atmosphere at a reducing temperature for a reduction time sufficient to produce a hydrogenated titanium alloy product. Following co-reduction 120, a heat treating 130 of the hydrogenated titanium alloy product can be performed. The heat treatment step can be maintained under a hydrogen atmosphere and a heat treating temperature sufficient to reduce pore size and specific surface area to form a heat treated hydrogenated titanium product. The method 100 can further include deoxygenating 140 the heat treated hydrogenated titanium product to reduce residual oxygen to less than 0.3 wt % (or often less than 0.15% wt) to form a particulate deoxygenated hydrogenated titanium product. In some cases, a hydrogenated titanium product can be desirable to allow for storage and long term stability. However, upon producing a final titanium product a dehydrogenated product can be desired. Accordingly, the method 100 can optionally include dehydrogenating 150 the deoxygenated hydrogenated titanium product to form the particulate titanium alloy product. Each of these steps is discussed in more detail below.

As a source of titanium, the $TiO_2$ powder can include any titanium dioxide source powder. The titanium dioxide source powder can be produced from any suitable source such as natural materials extracted from the earth and/or pre-processed materials, such as natural rutile ($TiO_2$), ilmenite ($FeTiO_3$), and leucoxene (an alteration product of titanium containing minerals). Such materials may be composed of varying degrees of titania. A raw titanium ore starting material can be treated to increase titanium percentage. Typically, raw ore can have a titanium oxide content from about 50 to about 65 wt %. Although other methods can be used, raw titanium ore can be carbothermally reduced to form $TiO_2$-slag. Such low grade $TiO_2$-slag can often contain about 80 wt % titanium oxide, although from about 70 to 90 wt % may be achieved under varying feed and processing conditions. Specific conditions can vary, however as a general guideline, such carbothermal reduction can include heating to a temperature from about 1000° C. to 1600° C. The result is $TiO_2$-slag, which in addition to $TiO_2$ includes other reaction products or impurities, such as pig iron. Upgraded slag (UGS) tends to have $TiO_2$ content of about 92 to about 95 wt %. Other known hydrometallurgical or chemical metallurgical processes may be involved to produce highly concentrated raw material with $TiO_2$ content more than 80 wt %, and in some cases up to 99 wt %.

Regardless, the $TiO_2$ powder can include impurities, but is at least 50% and often greater than 80%, most often greater than about 95% $TiO_2$, and in some cases greater than about 99 wt % $TiO_2$, and in other cases greater than 99.5 wt % $TiO_2$. The source $TiO_2$ powder can be acquired at nearly any particle size. Common commercially available pure $TiO_2$ powder can often range from about 0.2 μm to 0.3 μm which may be too fine to safely process as described herein. However, the source $TiO_2$ powder can have a particle size from about 50 nm to about 500 μm, often about 1 μm to about 100 μm, in some cases from 3 μm to 80 μm, and often from 20 μm to 60 μm, and in some cases about 30 μm. For example, $TiO_2$ source powder sold as a pigment is produced at less than 300 nm. Such powder can be used as the source material for this process, but can be coarsened first by granulation and sintering. The resultant Ti metal or $TiH_2$ particles have average particles sizes greater than 20 microns, and often greater than 30 microns to avoid excess oxygen pick up during handling and storage. This source particle size can be adjusted by milling, sintering, agglomeration, and the like as discussed more fully hereinafter. Similarly, the source $TiO_2$ powder can have a specific surface area from 0.1 $m^2/g$ to 100 $m^2/g$, and in some cases from 30 $m^2/g$ to 50 $m^2/g$ (as measured by BET). Notably, during processing $TiO_2$ powder can be temporarily converted to intermediate titanium oxides such as, but not limited to, $Ti_2O_3$, $Ti_5O_9$, and the like. Such intermediate titanium oxides can also be suitable for use in this process.

As a complimentary particulate source the composite at least one alloying element powder can include elemental metals, metal oxides, metal hydrides, or combinations thereof. In one case, the at least one alloying element powder is a metal oxide powder. Non-limiting examples of suitable metal oxide powder can include $Al_2O_3$, $V_2O_5$, CuO, MnO, $V_2O_3$, $Fe_2O_3$, $Nb_2O_5$, $ZrO_2$, $MoO_3$, $MoO_2$, $Cr_2O_3$, $SnO_2$, $SiO_2$, $Ta_2O_5$, CoO, $WO_3$, NiO, and combinations thereof including oxides of elements in the above list with varying valence states. For example, $V_2O_3$ can allow for better wettability and lower dwell times or temperatures than $V_2O_5$ during sintering (i.e. homogenization steps).

Alternatively, or in addition, the at least one alloying element powder can include an elemental metal. Non-limiting examples of suitable elemental metals include Al, Mo, V, Nb, Ta, Fe, Cr, Mn, Co, Cu, W, Zr, Sn, Ni, Si, and combinations thereof. In one example, the at least one alloying element powder can include a metal hydride. Non-limiting examples of suitable metal hydrides include aluminum hydride, vanadium hydride, niobium hydride, tantalum hydride, zirconium hydride, silicon hydride, and combinations thereof.

In one example, the alloying element powder can also include a mixture of oxides and elemental powder. Regardless, the choice of alloying element powders can depend on the desired titanium alloy product. Appropriate molar ratios of elemental metals in feed powder can be chosen in order to produce a desired alloy. Non-limiting examples of titanium alloys which can be produced include Ti-6Al-4V, Ti-2.5Cu, Ti-8Mn, Ti-3Al-2.5V, Ti-5Al-2.5Fe, Ti-6Al-7Nb, Ti-13Nb-13Zr, Ti-15Mo-5Zr, Ti-10V-2Fe-3Al, Ti-8V-3Al-6Cr-4Mo-4Zr, Ti-6Al-2Sn-4Zr-2Mo-0.1Si, Ti-15Mo-3Al-2.7Nb-0.25Si, Ti-15Mo-2Sn-4Zr-4Mo-2Cr-1Fe, and the like.

Optionally, the metal oxide powder or composite powder mixture can be prepared prior to co-reduction such as pre-reduction, purification, particle coarsening, homogenization, and the like. For example, the metal oxide powder can be pre-reduced to a different oxidation state separately from the co-reduction step. In one case, $V_2O_5$ can be reduced to $V_2O_3$.

In some cases, the preparation of the composite particulate oxide mixture can include reducing impurities. For example, $TiO_2$ powder and/or alloying element powders can be pre-leached to remove impurities which are undesirable (i.e. interfere with processing or reduce value of the final product). Non-limiting examples of impurities which may be removed include silicon, silica, aluminum, chromium, vanadium, sodium, iron, magnesium, and the like. Impurities can be reduced or removed through any suitable technique such as, but not limited to, leaching (e.g. NaOH solution), electrolysis, precipitation, washing, and the like. For example, depending on initial feed quality and desired final alloy product quality, silicon can be reduced by dissolving in acid or precipitation. In some cases the desired content of silicon in a final titanium alloy product can be less than about 0.1 wt %, and in some cases less than 0.04 wt %. Accordingly, an optional desilication stage can be performed to further reduce silica content. As a general guideline, it can be desirable to reduce silica content in the solids to less than 0.04 wt %, and often less than 0.015 wt %.

In other cases, as a pre-reduction preparation, it can be desirable to adjust particulate size to a desired target size. In one specific example, the composite particulate oxide mixture can be coarsened by milling, homogenization, drying and grinding, debinding and sintering, and crushing. Milling of the $TiO_2$ powder and the at least one alloying element powder can form an oxide feed powder having a target particle size. Milling can be performed separately or collectively on the respective powders. In some cases, milling can be performed to achieve a target particle size of 100 to 1000 nm, and most often 200 to 600 nm.

Homogenizing of the oxide feed powder can form a composite homogeneous agglomeration. Homogenizing can be performed by mixing the oxide feed powder in a mixture of water and a suitable suspending agent. Suspending agents can serve to suspend particles in water to allow for more uniform mixing upon subsequent drying. Non-limiting examples of suspending agents can include polyethylene glycol (PEG), polyvinyl alcohol (PVA), and the like. A mass ratio of oxide feed powder to water can range any functional amount to allow uniform mixing of powders. However, as a general guideline a mass ratio of water to feed powder can be about 0.5:1 to 3:1, 0.8:1 to 1.5:1, and in some cases about 1:1. The suspending agent can also be provided in an amount sufficient to produce homogeneous mixing of the powders. As a general guideline, suspending agent can comprise 0.5 to 5 wt % of the oxide mixture. The water can optionally be pre-heated to fully and quickly dissolve PEG or other suspending agents.

Drying and grinding the composite homogeneous agglomeration can form a homogenized composite oxide powder. Drying can be performed at temperatures above the evaporation temperature of water, while grinding can be performed to separate agglomeration. Typically grinding can merely involve loosening agglomerated particles rather than particle size reduction. As a general guideline, dried and grinded powders can range from about 50 to 200 mesh, and in one example about 100 mesh.

Debinding and sintering of the homogenized composite oxide powder can form a sintered composite oxide material. Debinding and sintering can be performed at atmospheric pressures, while debinding and sintering is typically performed in multiple stages, e.g. a low temperature debinding stage and a high temperature sintering stage. For example, a debinding temperature can generally range from about 100° C. to about 400° C. Once debinding is completed, the mixture can be heated to a sintering temperature of about 1000° C. to 1800° C. The sintering stage can be performed to coarsen the oxide particles. Debinding and sintering can be accomplished in a single heating stage, although multiple heating stages can typically be used. Debinding and sintering times can generally range from about 2 hours to about 24 hours, and most often from 3 hours to 8 hours. Similarly, sintering can generally range from about 2 hours to about 8 hours. Intermediate heating stages to reach the debinding and sintering temperatures, as well as cooling down to room temperature, also tend to result in a total debinding and sintering time of about 12 to 48 hours. In some cases, debinding and sintering can act as a homogenizing stage in order to improve uniformity of Ti and alloying metal powder distribution throughout the composite powder.

Sintering can also cause some agglomeration of powder. As a result, crushing can be performed to separate agglomerated powder. The sintered composite oxide powder can be in the form of agglomerated particles each having different metal oxides physically bonded together or can be a mixture where each particle is a single metal oxide. Regardless, crushing the sintered composite oxide material to form a sintered homogenized composite oxide powder having a magnified particulate size with respect to the target particle size. The magnified particulate size can vary, but is generally from about 0.5 μm to about 300 μm, and often from about 10 μm to about 250 μm, and in some cases from 25 μm to 50 μm. Such increase in the feed powder size can reduce chances of undesirable combustion and otherwise stabilize the feed powder.

Co-reduction of the composite particulate oxide mixture can include exposing the mixture to the metallic reducing agent under a hydrogen atmosphere at a reducing temperature to produce a hydrogenated titanium alloy product. Typically, the metallic reducing agent as a solid particulate can be physically mixed with the composite particulate oxide mixture and then heated to a reducing temperature. The metallic reducing agent can have a stronger oxidation potential than that of titanium. The presence of hydrogen helps to destabilize Ti—O system and make it easier for the reduction of oxide mixture by the metallic reducing agent.

After the reduction, the reduced product is cooled from the reduction temperature to room temperature. Maintaining a hydrogen atmosphere during cooling will lead to formation of titanium hydride. The exact content of hydrogen in the Ti alloy depends on the specific temperatures and the dwell time at those temperatures. Typically upon furnace cooling, the titanium product at the end will be titanium hydride products with 3-4 wt % of hydrogen. The co-reduction step produces the hydrogenated titanium alloy product chemically separated from metal impurities. Chemically separated indicates that the titanium is not alloyed or chemically bond with other metal impurities other than the alloying elements.

The metallic reducing agent can be at least one of a magnesium reducing agent and a calcium reducing agent. In one example, the metallic reducing agent is the magnesium reducing agent including Mg. $MgCl_2$ can optionally be added and mixed in to help facilitate the reaction. In principle, the reduction reaction can proceed with only Mg and $H_2$. However, in order to increase the kinetic rate of the reaction, the reaction can be carried out in a molten salt medium. For example, $MgCl_2$ can be used. At the reaction temperature, $MgCl_2$ is in a molten state which facilitates the reaction, but does not participate in the reduction reaction. Reducing temperatures for magnesium reducing agents can generally range from about 600° C. to about 950° C. and most often 645° C. to 800° C. The reducing agent can be present at a mass ratio of oxides to reducing agent from 1:1 to 1:5, and most often about 1:1 to 1:2. Although described in more detail herein, the metallic reducing agent can be introduced in at least stoichiometric amounts, and in some cases up to about 6 times the mole amount of Ti and alloying elements.

Figure 2A:
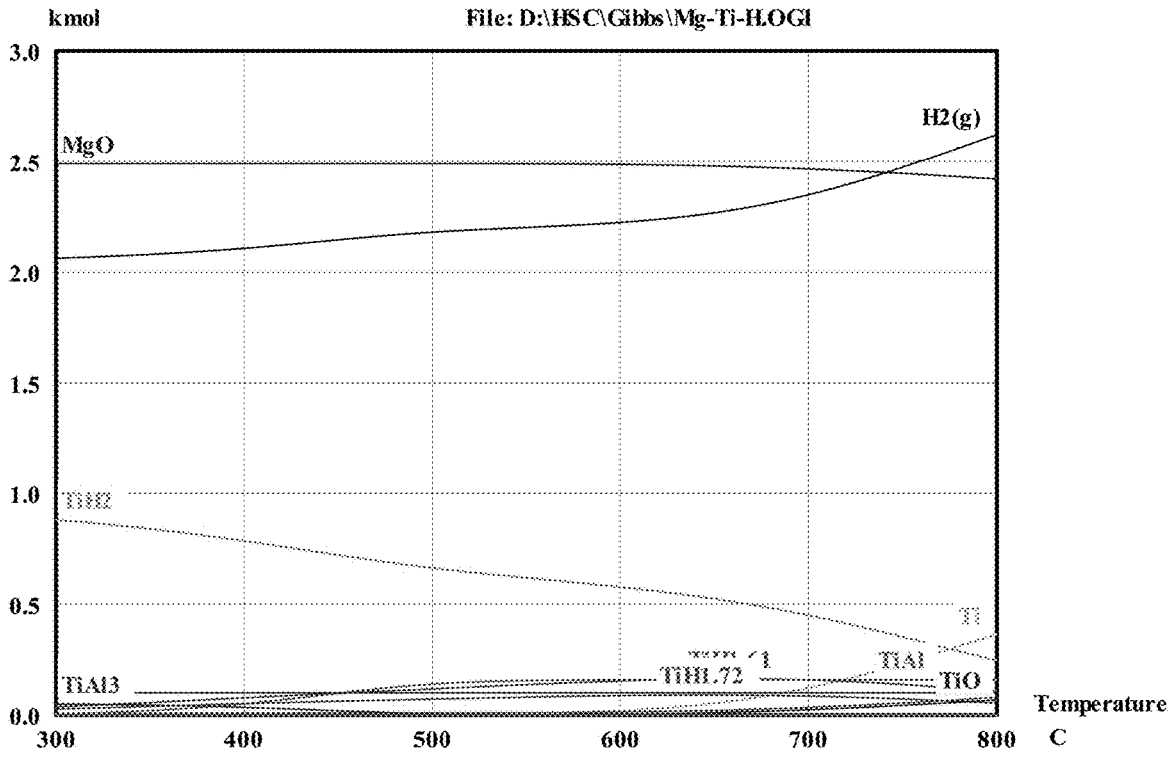
FIG. 2A is a graph of theoretical calculations showing the relative co-reduction of certain oxides with stoichiometric amounts of Mg in hydrogen.
Figure 2B:
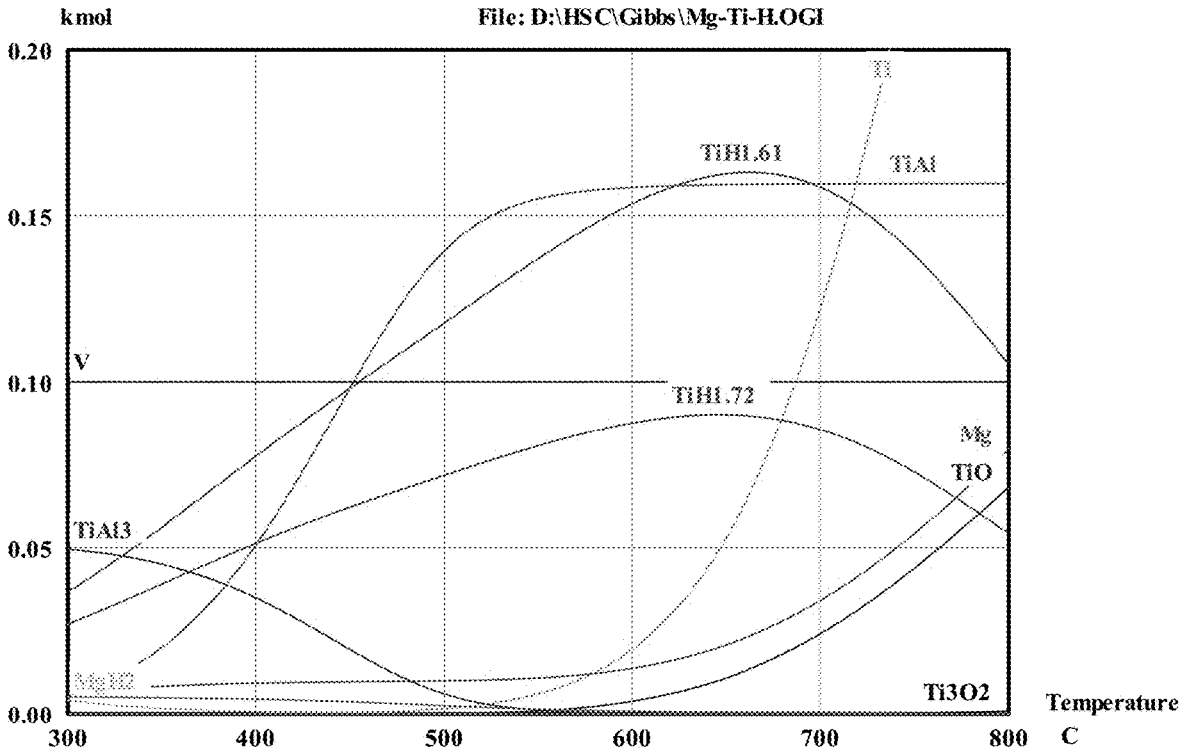
FIG. 2B is a reproduction of FIG. 2A with a magnified y-axis to show more detail among the various hydrides and oxides.
Figure 2C:
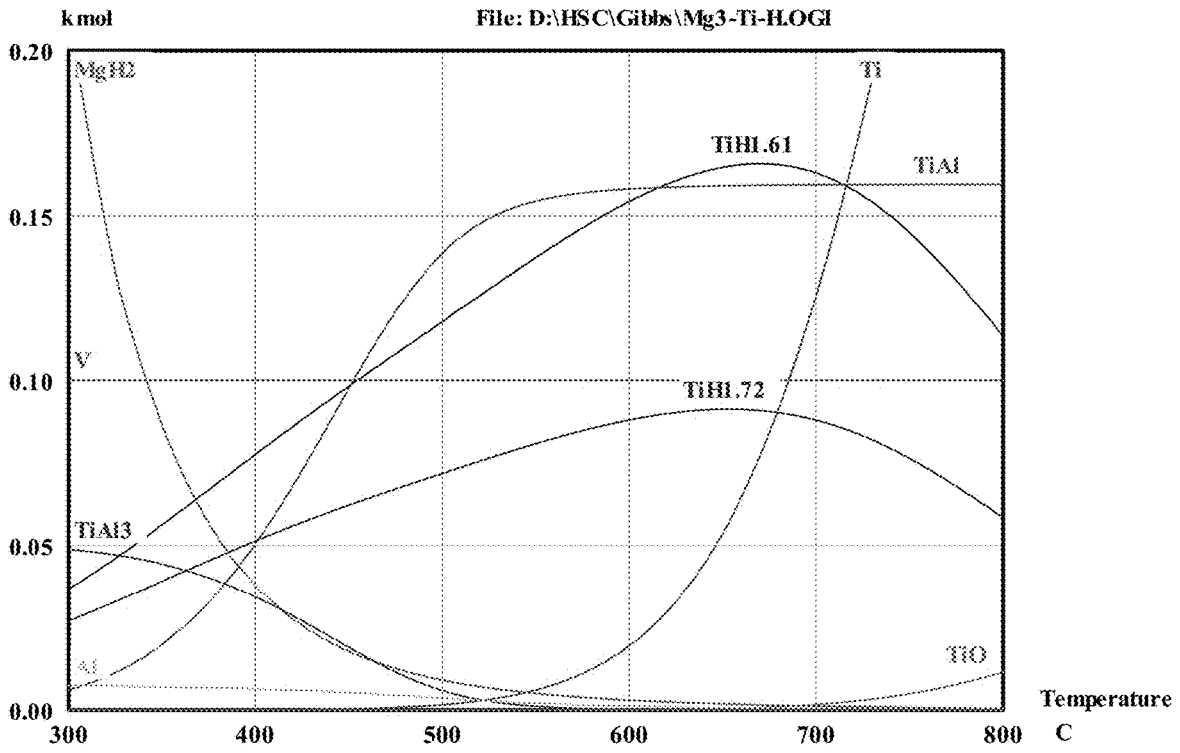
FIG. 2C illustrates the relative co-reduction of certain oxides with 1.2 times the stoichiometric amounts of Mg in hydrogen.
Figure 2D:
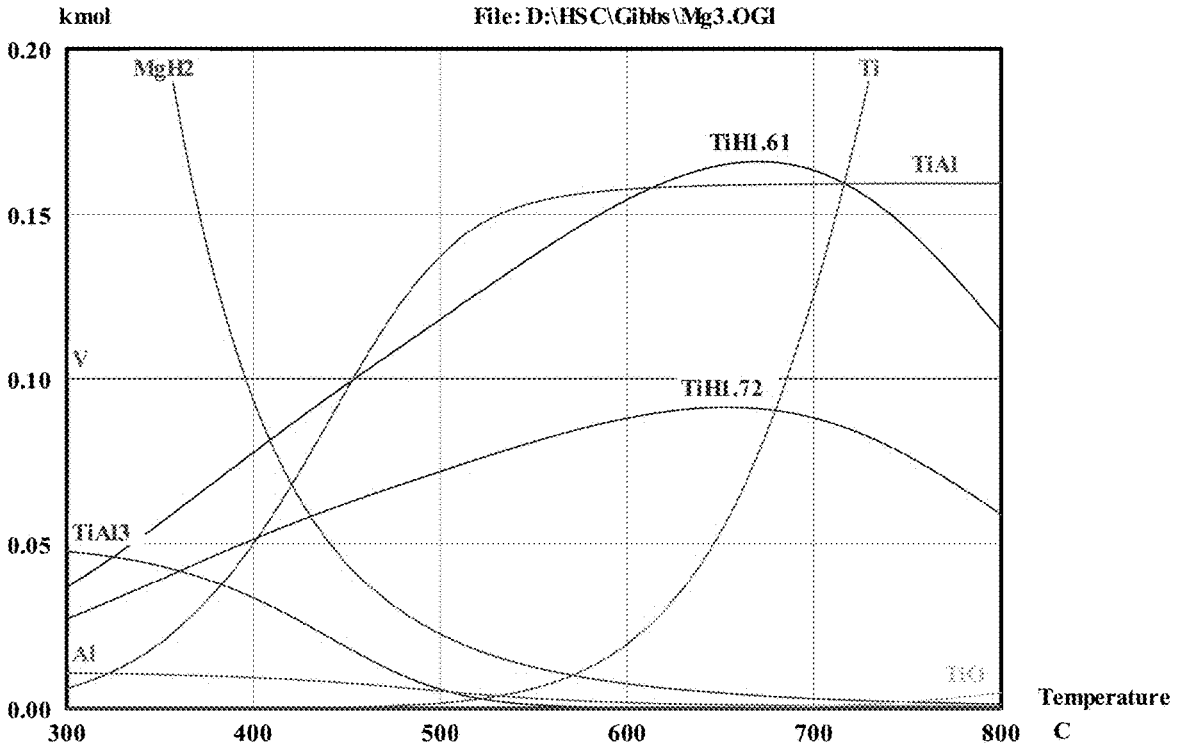
FIG. 2D illustrates the relative co-reduction of certain oxides with 1.5 times the stoichiometric amounts of Mg in hydrogen.
Figure 2E:
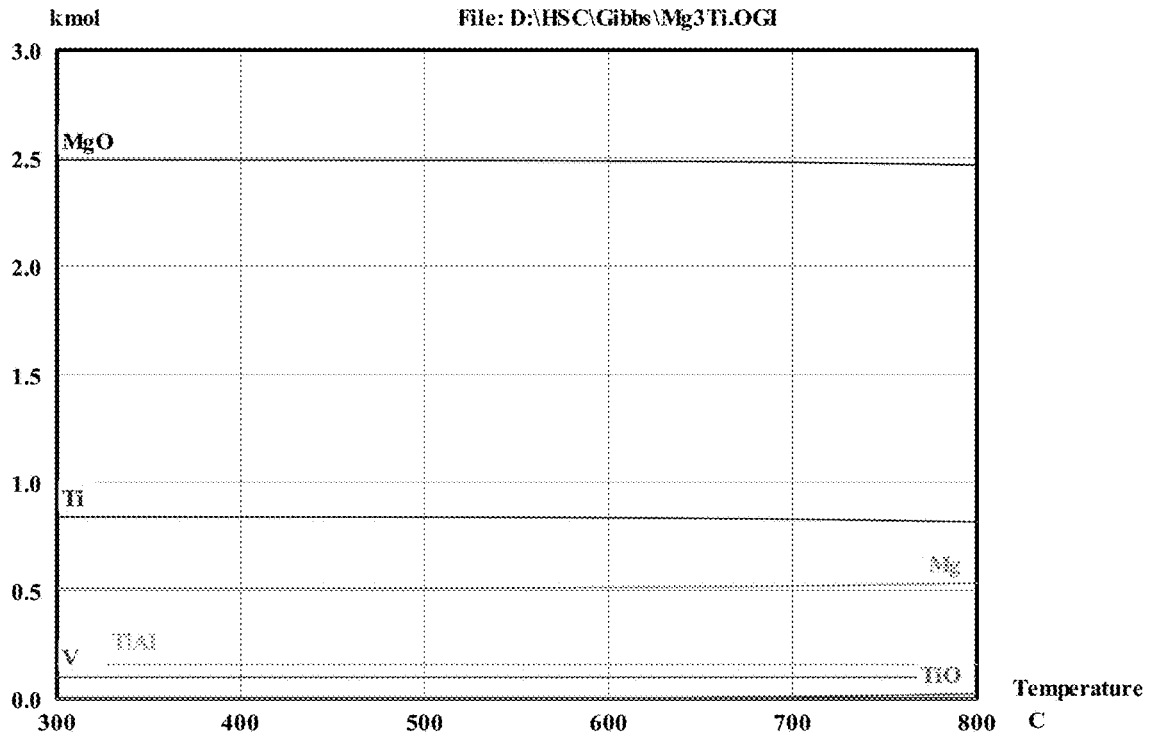
FIG. 2E illustrates the relative co-reduction of these oxides at 1.2 times stoichiometric in argon.
Figure 2F:
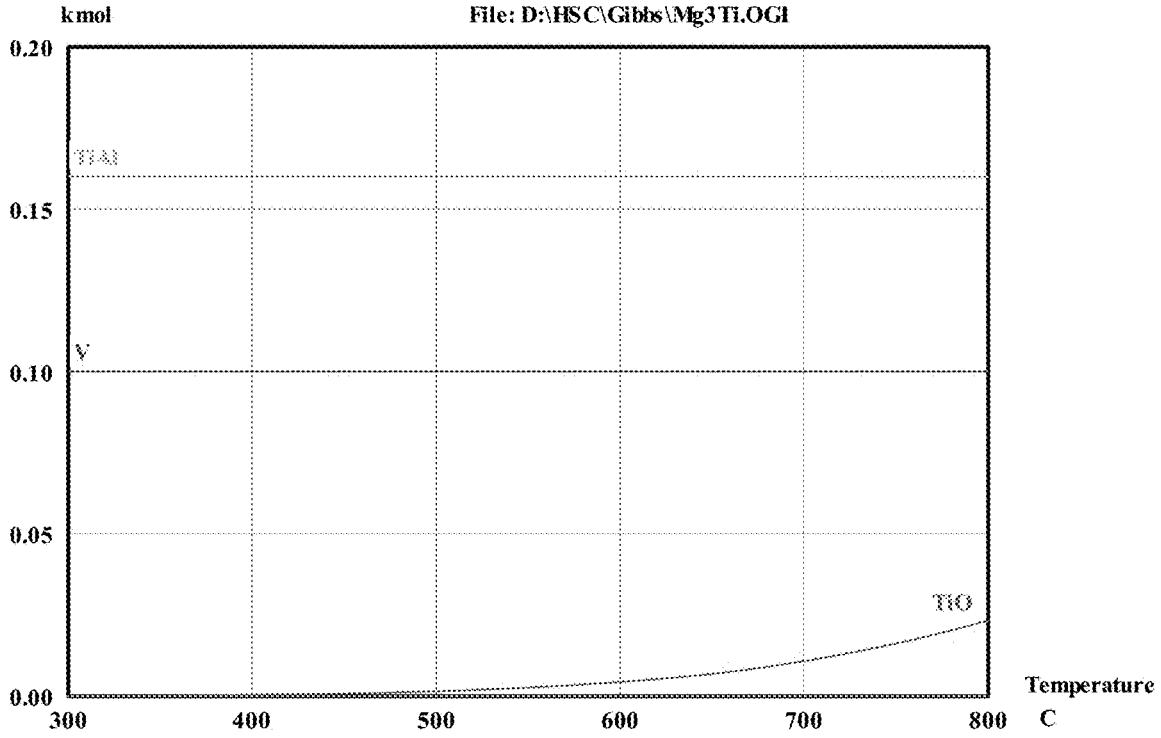
FIG. 2F illustrates the relative co-reduction of these oxides at 1.5 times stoichiometric in argon.

For example, FIG. 2A illustrates the relative co-reduction of certain oxides with stoichiometric amounts of Mg in hydrogen. FIG. 2B is a reproduction of FIG. 2A with a magnified y-axis to show more detail among the various hydrides and oxides. Note that the amount of TiO increases significantly with temperature above about 600° C. Further, Al is present as TiAl from about 500° C. to 800° C., while V is present as elemental V at all temperatures. Similarly, FIG. 2C illustrates the relative co-reduction of certain oxides with 1.2 times the stoichiometric amounts of Mg in hydrogen. Note that the amount of TiO decreases substantially above 700° C., compared to the TiO amount in the system with 1 times the stoichiometric amounts of Mg (FIG. 2A). FIG. 2D illustrates the relative co-reduction of certain oxides with 1.5 times the stoichiometric amounts of Mg in hydrogen. The amount of TiO further decreases above 700° C. with this increase to 1.5 times stoichiometric Mg content, compared to FIGS. 2A and B. FIGS. 2B, C and D show the influence of Mg amounts on the amount of TiO above 700° C., e.g. the more TiO remaining, the less reduction is completed. As a point of comparison FIGS. 2E and 2F illustrate the relative co-reduction of these oxides at 1.2 and 1.5 times stoichiometric in argon. Notably, the use of argon instead of hydrogen results in largely temperature independent variation and produces more TiO at elevated temperatures compared to co-reduction under hydrogen.

Alternatively, the metallic reducing agent can be one or both of Ca and $CaH_2$. Calcium can be effective, although reduction temperatures tend to be about 750° C. to 850° C. which is generally higher than Mg reducing agents. Regardless of the reducing agent chosen, the reducing temperature can be sufficient to maintain the metallic reducing agent in a molten state during co-reduction (e.g. 649° C. for Mg, 714° C. for $MgCl_2$, 842° C. for Ca, and 772° C. for $CaCl_2$).

In another alternative, molten salts can be used to facilitate the co-reduction process because the kinetic rates of the reactions can be improved by the use of the liquefied salt. Specifically, molten salts have very high conductivity and facilitate electron transfer during the reduction reaction. Molten salts also have the effect of helping dissolving by-products such as MgO or CaO during the reduction process. In addition to mono-metal chloride, binary salts such as $MgCl_2$+NaCl, $MgCl_2$+KCl, and $MgCl_2$+$CaCl_2$ can be used along with other binary and ternary salt mixtures.

Regardless of the specific metallic reducing agents, hydrogen gas concentration can be maintained during co-reduction in order to produce a hydrogenated titanium alloy product. Co-reduction can generally include three stages, i.e. initial heating, dwell stage, and cooling. Initial heating can most often be performed from about room temperature to the reducing temperature. During initial heating an inert gas such as argon can be used, although hydrogen could be used. In one example, co-reducing is performed by heating to the reducing temperature under an inert gas and then introducing the hydrogen atmosphere within about 10% of reaching the reducing temperature. Reducing temperatures from about 700° C. to about 800° C. can be useful depending on the reducing agents chosen, including mixtures of reducing agents. The reducing temperature can be maintained for a desired dwell time sufficient to co-reduce the titanium oxide and metal oxides. Dwell times can vary, but are generally from 4 to 24 hours, in some cases 4 to 18 hours, and most often 6 to 8 hours. The co-reduction step can be maintained sufficient to achieve an oxygen content of the hydrogenated titanium alloy product of less than about 3 wt %, and most often less than about 2 wt %, and in some cases about 1 wt %. A majority of this residual oxygen is in the form of dissolved oxygen (i.e. a solid solution) in the metal alloy.

The thermodynamic driving force for reduction of $TiO_2$ using Mg can be significantly improved in the presence of hydrogen. Hydrogen acts as a temporary destabilizing aid (e.g. alloying element) to help the reduction of $TiO_2$ and alloying metal oxides during the reduction step. The presence of hydrogen during deoxygenation can ensure the removal of oxygen by Mg (i.e. or Ca) until the oxygen content is sufficiently low (i.e. <0.2 wt %). However, the hydrogen content in Ti is a function of temperature. For example, at relatively higher temperatures (>400° C.), Ti contains hydrogen, but it is not uniformly present as a hydride. Rather, hydrogen can dissolve in Ti to some extent without forming hydride, i.e. $TiH_2$ or $TiH_{2-x}$. Although pressures can be varied, the reducing pressure is typically about atmospheric and generally within about 100% of atmospheric pressure.

Additionally, forming $TiH_2$, rather than Ti metal, is advantageous because Ti metal is more prone to forming alloys with other elements such as Fe, which can be difficult to separate. In addition, $TiH_2$ has very unique chemical properties. It is insoluble in water, resistant to moderate acid solutions, and has minimum or no solubility for other impurities in the $TiO_2$ rich material. Furthermore, $TiH_2$ is impervious to oxygen pickup compared to Ti metal, which helps to keep oxygen levels low in the final metal product. It should be noted that the insolubility of $TiH_2$ in water is attributed to its kinetic passivation by water. At the reducing temperature which is the high temperature in this process, hydrogen content in Ti is relatively low. The alloy (i.e. Ti plus alloying metals) is a solid solution of hydrogen in Ti. At this temperature, alloying can take place. However, after the material is cooled down in the hydrogen atmosphere, as the hydrogen content in Ti increases, it will gradually transform to $TiH_2$. After it forms $TiH_2$, it will be more difficult than if it is Ti metal to dissolve in any more alloying elements. Accordingly, this process provides a controlled alloying where $TiH_2$ acts to limit alloying of metals to those intentionally introduced. These properties set up a condition by which the product of the direct reduction of purified $TiO_2$ can be sequentially leached to remove other impurity elements to separate and purify the $TiH_2$. Although the chemical resistance of $TiH_2$ enables it to be separable from other impurities, if the particle size of $TiH_2$ is too small, e.g. in the sub-micrometer scale, it can also become soluble in those solutions.

In one example, the cooling stage can include a hydrogen atmosphere where inert gas is optionally included. The concentration of optional inert gas can be varied in order to carefully maintain hydrogenation and formation of $TiH_2$. Thus, after reduction, heat treatment, or deoxygenation, the titanium alloy material can be cooled down During cooling, equilibrium hydrogen content in Ti will increase with the decreasing temperature, under the same pressure (e.g. 1 atm and flowing hydrogen gas). After the product is completely cooled down to room temperature, titanium is largely in a hydride condition.

Notably, co-reduction tends to produce a porous material having an increased surface area. Although results can vary, the hydrogenated titanium alloy product is a particulate which can have a specific surface area from 0.1 $m^2/g$ to 100 $m^2/g$, and an average particle diameter from 1 μm to 100 μm. The size and morphology of the porous material is generally inherited in hydrogenated alloy product produced by Mg reduction in hydrogen.

Following co-reduction the hydrogenated titanium alloy product can include titanium alloy hydride, titanium hydride, alloy metal hydrides, pure elemental titanium and other elemental alloying metals, while also including MgO as a by-product of co-reduction along with unreacted $MgCl_2$. MgO can be removed through a leaching step. For example, a weak acid such as, but not limited to, dilute HCl, organic acids, HCl—$HNO_3$ solution, acetic acid, ammonium chloride, and the like can be used to leach MgO to leave a hydrogenated titanium alloy rich product. Dilute HCl aqueous solution is particularly effective for leaching of MgO to obtain clean purified hydrogenated titanium alloy product. Typically, this alloy product can have a titanium content greater than about 95 wt %. The resulting hydrochloric acid can be reused in the leaching process as needed and the remainder sold.

Subsequent to co-reduction, the heat treatment step can be performed by heating to a heat treating temperature in order to densify and coarsen the particulate which results in a reduced pore size and reduced specific surface areas. The heat treating can also produce a more uniform particle size and exterior surface morphology. As an example, the heat treating temperature is from 700° C. to 1500° C., and in some cases about 1100° C. Further, a hydrogen atmosphere is introduced when the hydrogenated titanium alloy product is heated to the heat treating temperature. During heat treatment, inert gas may be used while heating the hydrogenated titanium alloy product to the heat treating temperature and then switched to hydrogen atmosphere (e.g. optionally mixed with inert gas). Heat treatment can include a dwell time at the heat treatment temperature under the hydrogen atmosphere. Although conditions can vary, dwell times of about 1 minute to 10 hours can be sufficient, and most often from 1 to 4 hours. Cooling from heat treatment can generally include maintenance of at least sufficient hydrogen gas to maintain hydrogenation of the hydrogenated titanium alloy product. Thus, in some cases a mixture of hydrogen and inert gas (e.g. argon) can be maintained during cooling, although hydrogen alone could also be used during cooling. Hydrogen atmosphere can also be maintained during cooling so as to control hydrogen content in the cooled product. For example, excessively high hydrogen content can make the product brittle, At this stage, a brittle material can be desirable so that is can be broken into particles of a target size. After heat treatment, the particles can be bonded to each other, forming an agglomerated bulk mass. In order to produce a powder product, it is desired to be able to break the bulk mass into a powder with a desired particle size. If no hydrogen is used during cooling, Ti metal will be obtained which can be very difficult to pulverize. Another benefit of forming hydride after heat treatment is to prevent the material from picking up an excessive amount of oxygen. Some minor oxygen pick up is difficult to avoid but such oxygen pickup should generally be minimized. As a general guideline, the heat treating step controls the hydrogen content in the heat treated powder to vary between a fraction to a few percent, and often between 0.5 to 3.0% by adjusting the hydrogen concentration in the hydrogen atmosphere. In some cases, a hydrogenated titanium alloy powder with a minor amount of hydrogen content (e.g. 1.0 to 2 wt %) is beneficial for separating particles that may have partially bonded during the heat treatment.

Although coarsening via heat treatment can vary depending on the materials and conditions, as a general rule, the coarsened particulate can be in the form of an agglomerated porous bulk material that can be crushed and optionally milled to a desired target particle size. Particle size after crushing and milling is a function of the extent of crushing. The heat treatment closes fine pores to produce pore sizes less than 10 microns. Therefore, after being crushed into powder with particles sizes in the range of 10-100 microns, individual particles are solid particles. Without heat treatment, without closing the fine pores, the particles with 10-100 micron sizes will be mini porous sponge. In one example, heat treated hydrogenated titanium product is a coarsened particulate having a coarsened specific surface area from 0.01 $m^2/g$ to 0.5 $m^2/g$ and in some cases 0.08 $m^2/g$ to 0.15 $m^2/g$, and an average particle diameter from about 10 to about 1000 μm and in some cases to about 300 μm, and often from about 50 μm to about 150 μm. The specific ideal size range will also depend on the intended use of the powder.

The size and uniformity of particulate powder can influence the quality and consistency of later processing. Thus, in some cases it can be desirable to crush the heat treated hydrogenated titanium product to reduce agglomeration and form a particulate powder having an average particle size from 1 μm to 1000 μm, preferably 10-200 μm.

Although much of the oxygen present as oxides can be removed via the co-reduction step, residual oxygen tends to be present in the form of minute amounts of oxides and some minor dissolved oxygen in solid solution. Oxygen (O) has a high solubility in titanium. In α-Ti, the solubility is up to 33.3 at. % (14.3 wt. %). Dissolved oxygen also has an adverse effect on the mechanical properties of Ti alloys. Even 0.35 wt % oxygen can be significantly detrimental to the mechanical properties of titanium alloy products, especially ductility. Again, processing conditions can offer varied oxygen results, the hydrogenated and heat treated titanium alloy product can still have from about 0.5 wt % to about 3 wt % oxygen, which is approximately the same as the oxygen content in the product of co-reduction prior to the heat treatment.

Accordingly, an additional distinct deoxygenation step is performed to further reduce oxygen content. The deoxygenating can be accomplished by heating the heat treated hydrogenated titanium product with a deoxygenation agent at a deoxygenation temperature and again under a hydrogen atmosphere. Non-limiting examples of suitable deoxygenation agents includes Mg, Ca, and $CaH_2$. Typically, the deoxygenation can be facilitated using a molten salt as a deoxygenation medium to increase kinetic rates of reaction. Examples of molten salts can include, but are not limited to $MgCl_2$ and $CaCl_2$. In another specific example, the molten salt can be a calcium halide eutectic salt including $CaCl_2$ and at least one of KCl, LiCl and NaCl. Non-limiting examples of calcium salts can include $CaCl_2$, $CaBr_2$, $CaI_2$, $CaCl_2$—LiCl, $CaCl_2$—KCl, $CaCl_2$—$MgF_2$, $CaCl_2$—LiF, $CaCl_2$—KF, $CaCl_2$—NaF, $CaCl_2$—NaBr, $CaCl_2$—LiBr, $CaCl_2$—KBr, $CaCl_2$—NaI, $CaCl_2$—LiI, $CaCl_2$—KI, $CaBr_2$—LiCl, $CaBr_2$—KCl, $CaBr_2$—$MgF_2$, $CaBr_2$—LiF, $CaBr_2$—KF, $CaBr_2$—NaF, $CaBr_2$—NaBr, $CaBr_2$—LiBr, $CaBr_2$—KBr, $CaBr_2$—NaI, $CaBr_2$—LiI, $CaBr_2$—KI, $CaI_2$—LiCl, $CaI_2$—KCl, $CaI_2$—$MgF_2$, $CaI_2$—LiF, $CaI_2$—KF, $CaI_2$—NaBr, $CaI_2$—LiBr, $CaI_2$—KBr, $CaI_2$—NaI, $CaCl_2$—$CaBr_2$, $CaCl_2$—$CaI_2$, $CaCl_2$—$CaF_2$, $CaBr_2$—$CaI_2$, $CaBr_2$—$CaF_2$, $CaI_2$—$CaF_2$, and combinations thereof.

Generally, a calcium halide eutectic salt can be mixed with solid calcium in the presence of the titanium alloy product at temperatures below the melting point of calcium. The calcium halide eutectic salt can be formed by mixing calcium halide with an alkali metal halide and heating to a eutectic melting temperature below the melting temperature of calcium (i.e. 842° C.). Most often the eutectic melting temperature can be at least 30° C. below the temperature of deoxygenation. In another specific example, the deoxygenation agent is Mg with $MgCl_2$ as a molten salt medium. Deoxygenation can also utilize a modest amount of deoxygenation agent. For example, a heat treated hydrogenated titanium product to deoxygenation agent mass ratio of 1:0.2 to 1:1 can be suitable.

Generally, the deoxygenation temperature is sufficient to melt both the deoxygenation agent and the salt medium. The deoxygenation step can be performed by heating the heat treated hydrogenated titanium product under an inert gas atmosphere to within about 10% of the deoxygenation temperature, and then maintaining the hydrogen atmosphere during a dwell time of deoxygenation. As an example, the deoxygenation temperature can be from 650° C. to 800° C. Generally, the deoxygenation temperature can be sufficient to melt the deoxygenation agent and any salt used as a molten salt medium while also providing sufficient thermodynamic driving force to the reaction. Regardless, deoxygenation can result in a residual oxygen in the deoxygenated hydrogenated titanium product less than 0.2 wt %, and in some cases less than 0.15 wt %. Furthermore, the deoxygenated hydrogenated titanium product can often have a decreased specific surface area compared to the heat treated hydrogenated titanium product. In one example, the decreased specific surface area is 0.05 to 0.5 $m^2/g$.

From a thermodynamic point of view, there is a limit for minimizing oxygen in Ti using Mg (without hydrogen) at elevated temperatures, which is about ~1.5 wt % at 600° C. In addition, the deoxygenation of titanium requires diffusion of oxygen atoms within titanium (when oxygen level is less than 14.3 wt. %). When deoxygenation of titanium is carried out above ~900° C., titanium transforms from a hexagonal close-packed (HCP) to body-centered cubic (BCC) crystal structure. In the latter structure, the diffusion of oxygen becomes relatively more active. Before reaching the transformation temperature of titanium, the diffusion rate of oxygen is low; however, after transformation to bcc structure at the high temperature above transformation, atomic movement occurs more than 100 times faster than in HCP structure.

Calcium is one option for further minimizing oxygen from wt % to less than 0.2 wt % at high temperature. In one example, Ca metal can be mixed with the titanium powder and heated to an elevated deoxygenation temperature. As a general guideline, temperatures from about 500° C. to about 1000° C. can be suitable. In one aspect, $CaH_2$ may be used as the reductant. $CaH_2$ is able to minimize the oxygen content in Ti less than 0.2 wt %.

Thus, in one example, the hydrogenated and heat treated titanium alloy powder, obtained from a magnesium or magnesium hydride co-reduction process, can be mixed with $CaH_2$ or $CaH_2/CaCl_2$ and heated up to a temperature higher than that for a magnesium or magnesium hydride co-reduction process and held there for sufficient period of time to allow the removal of residual oxygen content in the titanium or titanium hydride powder. The unreacted $CaH_2$, $CaCl_2$ and produced CaO in the product of the $CaH_2$ co-reduction process can then be washed away to obtain the deoxygenated hydrogenated titanium alloy powder with minimized residual oxygen.

Optionally, the method can further include removing residual metallic reducing agent and respective reducing agent oxides from the hydrogenated titanium alloy product or the heat treated hydrogenated titanium product prior to deoxygenating. Deoxygenation can also result in formation of CaO or MgO. As a result, deoxygenation agent and residual CaO or MgO can be removed by leaching after deoxygenation. For example, leaching can be performed as previously outlined with respect to removing such materials after co-reduction or as preparation of source powders.

After deoxygenation, the alloy powder can be maintained in a hydride form since the hydride minimizes oxygen pick up during storage over non-hydride forms. Thus, when the alloy powder is ready to be used, the alloy powder can be dehydrided to remove hydrogen (i.e. including hydride and residual dissolved hydrogen), typically to less than about 60 ppm.

When a non-hydrided alloy product is desired, dehydrogenating can include heating the deoxygenated hydrogenated titanium product in a hydrogen deficient atmosphere sufficient to drive hydrogen out from the deoxygenated hydrogenated titanium product to form the titanium alloy product having a hydrogen content less than about 100 ppm. The dehydrogenating can typically be performed at temperatures from 400° C. to 800° C. The dehydrogenating can typically maintain both pore size and specific surface area.

Advantageously, the method excludes electrolysis, chlorination, and reduction of titanium chloride. The methods also avoid melting of the titanium oxides, metal oxides, titanium, or metals during the method (i.e. reduction, heat treatment, deoxygenation, dehydrogenation, etc). As such, the process can occur under entirely solid state conditions.

Further, the titanium alloy product can be used as a feedstock for a VAR process. More specifically, instead of introducing both Ti sponge and a master alloy into a VAR furnace, the titanium alloy product can be introduced directly as a single feed. The titanium alloy product can similarly be used in other solid state alloying processes such as, but not limited to, plasma melting, electron beam melting, and the like.

Consistent with the above principles, the method can alternatively involve introducing alloying metals subsequent to reduction of the titanium oxides. For example, a method for producing a particulate titanium alloy product can include preparing a particulate oxide mixture including titanium oxide powder. The particulate oxide mixture can be reduced using a metallic reducing agent under a hydrogen atmosphere at a reduction temperature for a reduction time sufficient to produce a hydrogenated titanium product. At least one alloying element can be introduced to the hydrogenated titanium product to form a composite hydrogenated titanium product. The composite hydrogenated titanium product can be heat treated under a hydrogen atmosphere and a heat treating temperature to reduce pore size and specific surface area to form a heat treated hydrogenated titanium alloy product. The heat treated hydrogenated titanium alloy product can be deoxygenated to reduce residual oxygen to less than 0.3 wt % to form a deoxygenated hydrogenated titanium product. Optionally the deoxygenated hydrogenated titanium product can be dehydrogenated to form the titanium alloy product, where the deoxygenated hydrogenated titanium product and the titanium alloy product are a particulate. Each of these steps, materials and conditions can be performed using the guidance and principles laid out above with respect to co-reduction, although some efficiencies and advantages may be lost or different.

Typically, the at least one alloying element powder is an elemental metal. Similarly, in some cases the steps of introducing and heat treating are performed simultaneously, although the alloying metals can be introduced immediately prior to heat treatment.

Example 1

Figure 3A:
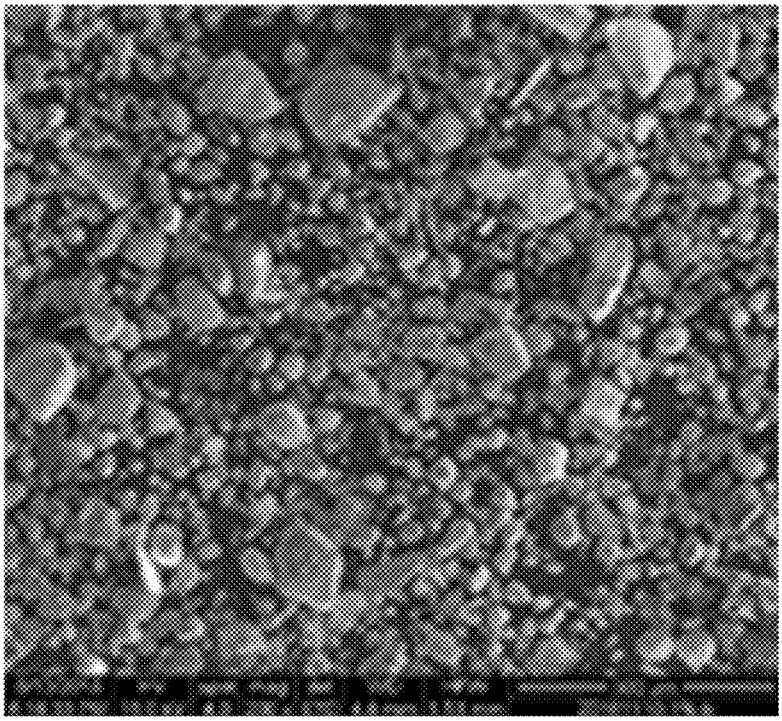
FIG. 3A is an SEM micrograph of a partially sintered composite metal oxide alloy particles in accordance with Example 1.
Figure 3B:
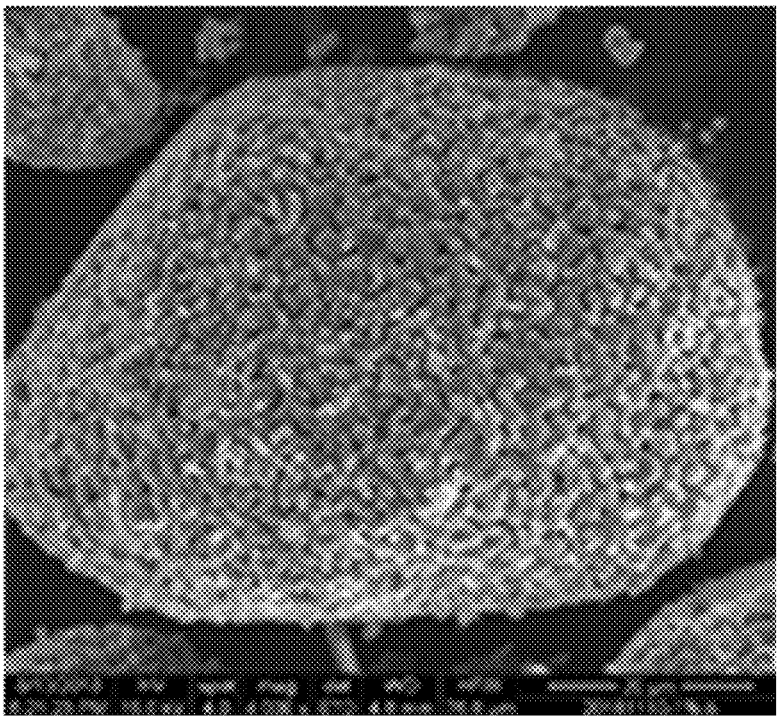
FIG. 3B is an SEM micrograph magnified from the view of FIG. 3A.

$TiO_2$ powder as a nano-sized pigment was obtained from Kronos. $Al_2O_3$ powder of less than 1 μm and 99.9% purity was obtained from Alfa Aesar. $V_2O_5$ powder having 99.6% purity and −10 mesh was commercially obtained from Alfa Aesar. The $V_2O_5$ powder was milled for 12 hours to produce particle sizes below 1 μm. The three source powders were homogenized to form a homogeneous powder mixture by mixing the composite powder into a 1.0% PEG aqueous solution at a water to powder mass ratio of 1:1. Note that the source powders can be introduced into the solution individually or as a composite mixture. The first batch included 600 g $TiO_2$, 45.3 g $Al_2O_3$, and 28.6 g $V_2O_5$. The mixture was then stirred for 2 hours to obtain a homogeneous mixture. The wet mixture was dried in a tray and ground to about 100 mesh. The dried material was then heated to 700° C. for about 2 hours to debind and then heated up (10° C./min) to about 1200° C. for about 4 hours to partially sinter the powder as shown in FIGS. 3A and 3B to form an agglomerated composite particle powder. The debinding and sintering step was performed under an argon atmosphere. The titanium oxide and alloying oxide particles bind together to produce larger composite particles with a wide size distribution (e.g. mean particle size of 128.8 μm, std dev of 0.13, and BET surface area of 0.85 $m^2/g$). EDS analysis of the composite particles is shown in Table 1.

TABLE 1

EDS analysis of composite particles.

| Element | wt % | at % |
|---|---|---|
| O | 34.31 | 60.06 |
| Al | 03.57 | 03.70 |

TABLE 1-continued

EDS analysis of composite particles.

| Element | wt % | at % |
|---|---|---|
| Ti | 59.39 | 34.73 |
| V | 02.74 | 01.51 |

Figure 3C:
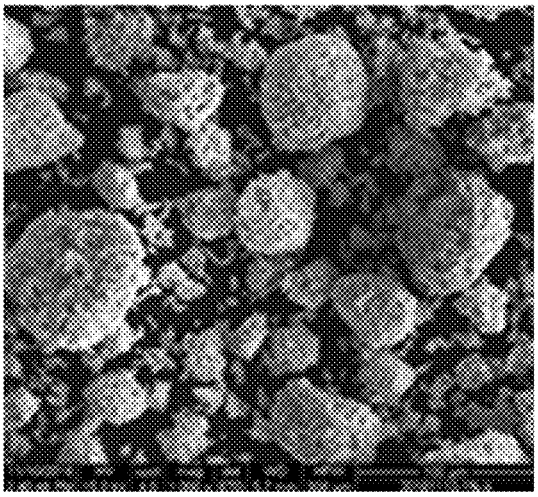
FIG. 3C is an SEM micrograph of a hydrogenated and reduced alloy powder produced in accordance with Example 1.
Figure 3D:
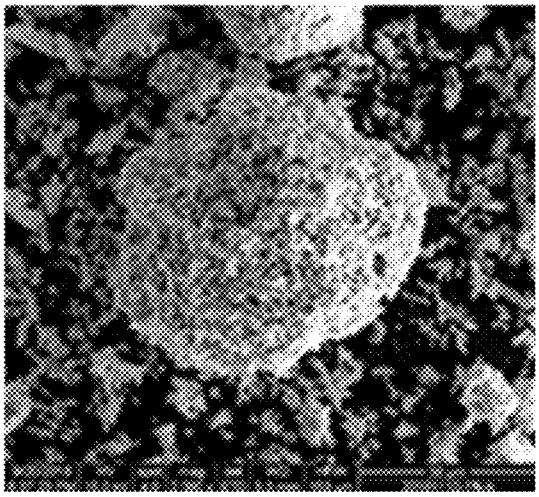
FIG. 3D is an SEM micrograph magnified from the view of FIG. 3C.

The agglomerated composite particle powder was then mixed with a mixture of Mg and $MgCl_2$ as a reducing agent and heated from room temperature under argon atmosphere to a reducing temperature of 750° C. The materials were mixed at an oxide: Mg:$MgCl_2$ mass ratio of 1:0.66:1. The argon atmosphere was then replaced with hydrogen and the temperature was maintained for 12 hours to reduce the alloy powder. The reduced alloy powder was then cooled to room temperature under pure hydrogen or a mixture of hydrogen and argon in order to maintain hydrogenation of the powder. FIGS. 3C and 3D illustrate the hydrogenated and reduced alloy powder having most of the oxides reduced and leaving a porous morphology. Oxygen content after co-reduction was 1.92 wt % (Al).

Figure 3E:
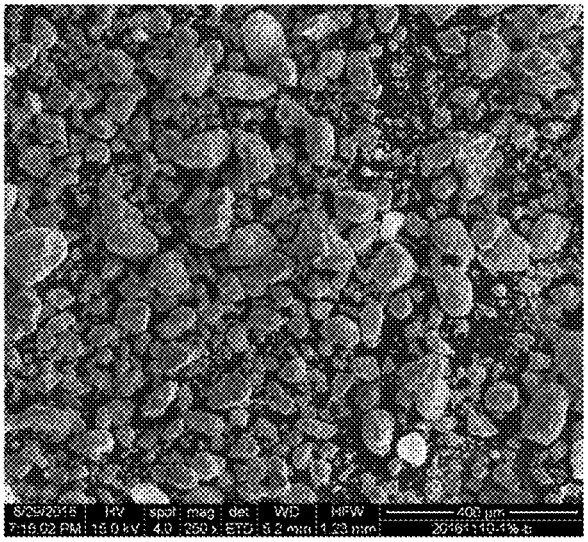
FIG. 3E is an SEM micrograph of a heat treated alloy powder produced in accordance with Example 1.
Figure 3F:
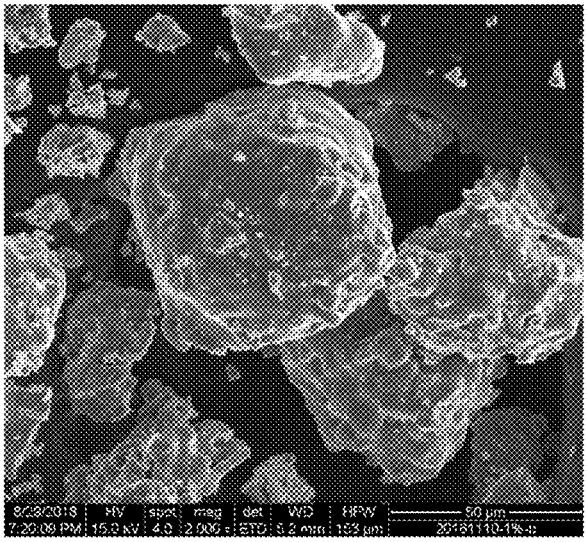
FIG. 3F is an SEM micrograph magnified from the view of FIG. 3E.

The hydrogenated and reduced alloy powder was then heated under argon from room temperature to a temperature of about 1100° C. at which point the argon was replaced with a hydrogen atmosphere and held for 3 hours as a heat treatment step to close pores. The heat treated powder was then cooled to room temperature under a mixture of argon and hydrogen or pure hydrogen. FIGS. 3E and 3F illustrate the heat treated and coarsened alloy powder. The resulting alloy powder had a mean particle size of 96.85 μm and specific surface area of 0.14 $m^2/g$.

Figure 3G:
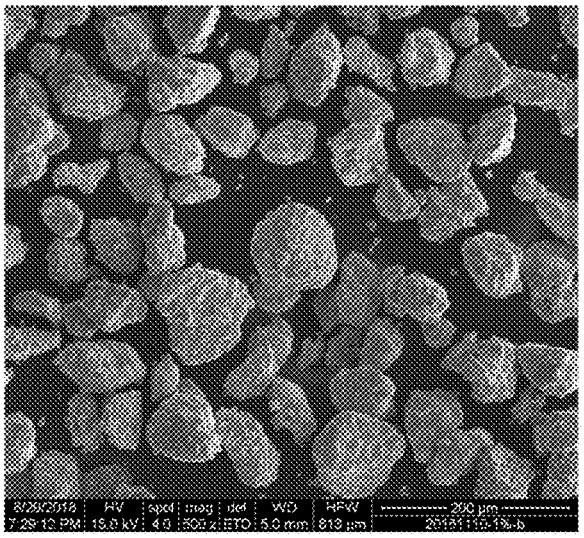
FIG. 3G is an SEM micrograph of a deoxygenated alloy powder produced in accordance with Example 1.
Figure 3H:
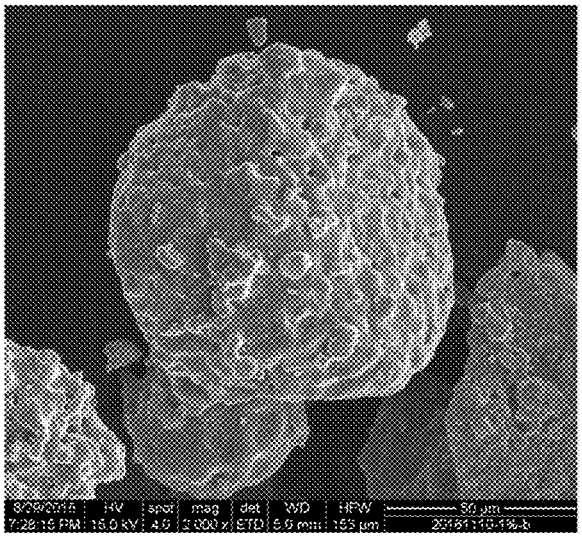
FIG. 3H is an SEM micrograph magnified from the view of FIG. 3G.

The heat treated alloy powder was then deoxygenated by mixing with Mg and $MgCl_2$ as a deoxygenation agent at a mass ratio of alloy powder:Mg:$MgCl_2$ of 1:0.2:0.3. The mixture was heated from room temperature to 740° C. under argon and then maintained at that temperature in a hydrogen atmosphere for 4 hours. Hydrogen concentration was maintained at about 1 to 4 wt % during cooling to produce a deoxygenated hydrogenated alloy powder as shown in FIGS. 3G and 3H. The resulting deoxygenated alloy powder had a mean particle size of 79.52 μm and specific surface area of 0.21 $m^2/g$. Note that the particle size and morphology remained largely consistent before and after deoxygenation. Table 2 shows the changes of mean particle size and specific surface area at different stages of alloy production. The results show that mean particle size decreases through heat treatment and deoxygenation. This is due to the removal of oxygen from oxides and shrinkage of particles during heat treatment. Specific surface area decreases dramatically after heat treatment because the pores are closed due to heat treatment. As titanium has strong affinity with oxygen, the decrease of specific surface area can also help decrease oxygen attached on the surface of titanium.

TABLE 2

Mean particle size, BET surface area and oxygen at different stages

| Stages | After coarsening sintering | After heat treatment | After deoxygenation |
|---|---|---|---|
| Mean particle size | 128.8 μm | 96.85 μm | 79.52 μm |
| BET surface area | 0.85 $m^2/g$ | 0.14 $m^2/g$ | 0.16 $m^2/g$ |
| Oxygen % | 1.92 (after reduction) | 2.37 | 0.25 |

Example 2

Figure 4A:
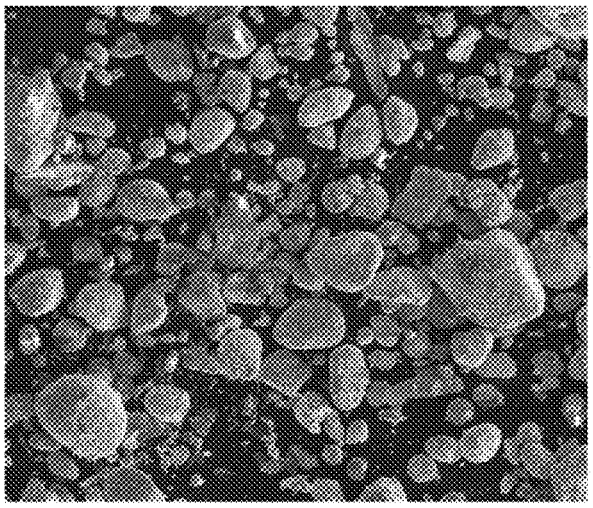
FIG. 4A is an SEM micrograph of a partially sintered composite metal oxide alloy particles in accordance with Example 2.
Figure 4B:
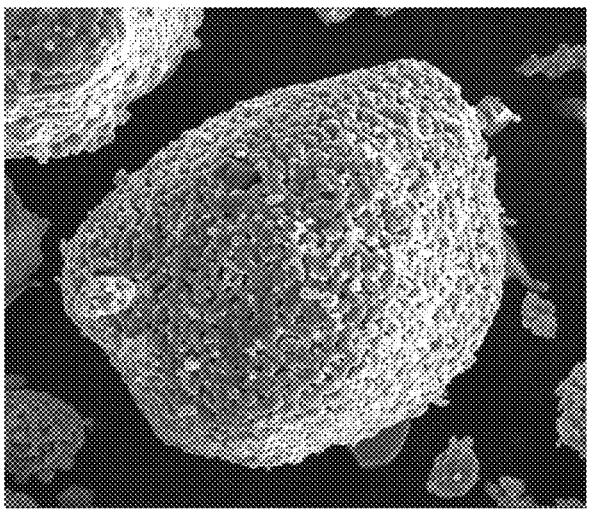
FIG. 4B is an SEM micrograph magnified from the view of FIG. 4A.

The conditions of Example 1 were largely repeated with a 10% increase in the weight of initial aluminum oxide added. The three source powders were homogenized to form a homogeneous powder mixture by mixing the composite powder into a _2_wt % PEG aqueous solution at a water to powder mass ratio of 1:1. The first batch included 600 g $TiO_2$, 49.8 g $Al_2O_3$, and 28.6 g $V_2O_5$. The mixture was then stirred for 2 hours to obtain a homogeneous mixture. The wet mixture was dried in a tray and ground to about 100 mesh. The dried material was then heated to 700° C. for about 2 hours to debind and then heated up (10° C./min) to about 1200° C. for about 4 hours to partially sinter the powder as shown in FIGS. 4A and 4B to form an agglomerated composite particle powder. The debinding and sintering step was performed under an argon atmosphere.

The agglomerated composite particle powder was then mixed with a mixture of Mg and $MgCl_2$ as a reducing agent and heated from room temperature under argon atmosphere to a reducing temperature of 750° C. The materials were mixed at an oxide:Mg:$MgCl_2$ mass ratio of 1:0.66:1. The argon atmosphere was then replaced with hydrogen and the temperature was maintained for 12 hours to reduce the alloy powder. The reduced alloy powder was then cooled to room temperature under pure hydrogen or a mixture of hydrogen and argon in order to maintain hydrogenation of the powder.

Figure 4C:
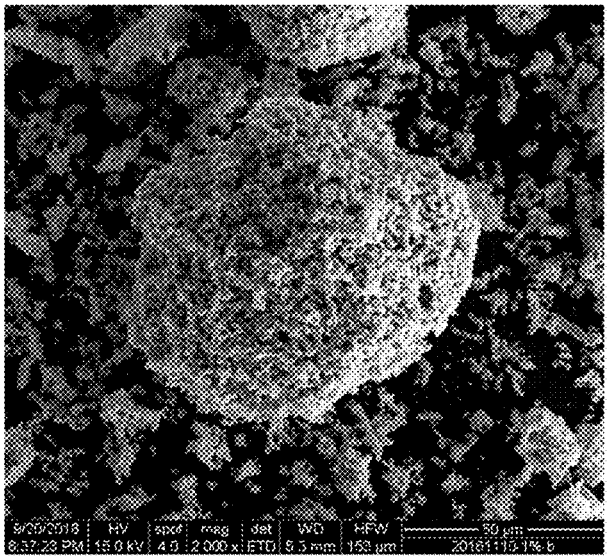
FIG. 4C is an SEM micrograph of a hydrogenated and reduced alloy powder produced in accordance with Example 2.

FIG. 4C illustrates the hydrogenated and reduced alloy powder having most of the oxides reduced and leaving a porous morphology. Oxygen content after co-reduction was 2.48 wt % (A2).

Figure 4D:
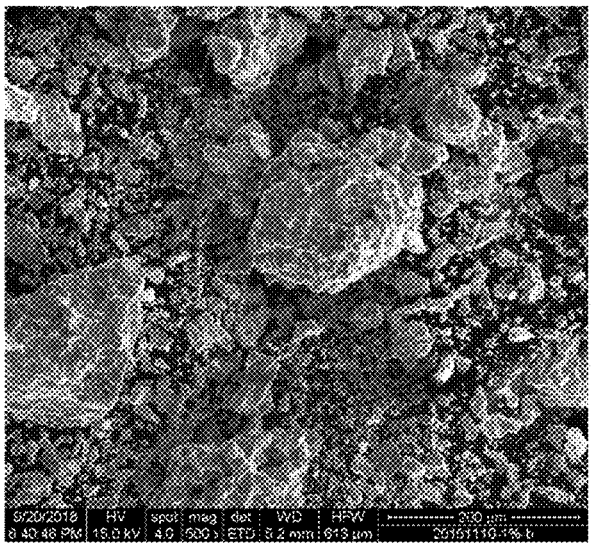
FIG. 4D is an SEM micrograph of a heat treated alloy powder produced in accordance with Example 2.
Figure 4E:
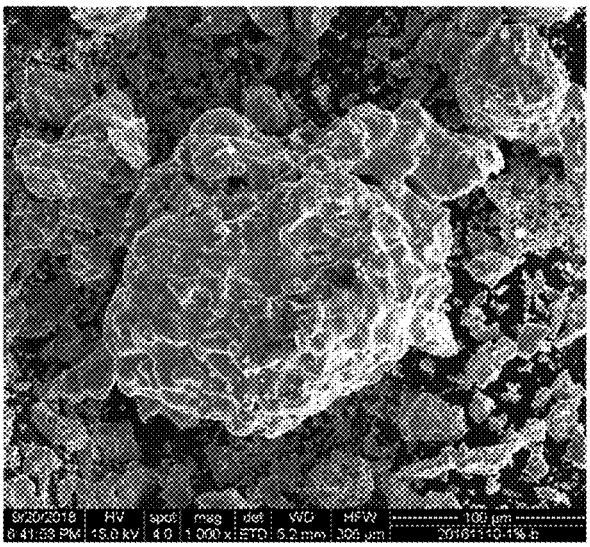
FIG. 4E is an SEM micrograph magnified from the view of FIG. 4D.

The hydrogenated and reduced alloy powder was then heated under argon from room temperature to a temperature of about 1100° C. at which point the argon was replaced with a hydrogen atmosphere and held for 6 hours as a heat treatment step to close pores. The heat treated powder was then cooled to room temperature under a mixture of argon and hydrogen. FIGS. 4D and 4E illustrate the heat treated and coarsened alloy powder. The resulting alloy powder was more difficult to crush that the powder of A1 due to the longer dwell time.

Figure 4F:
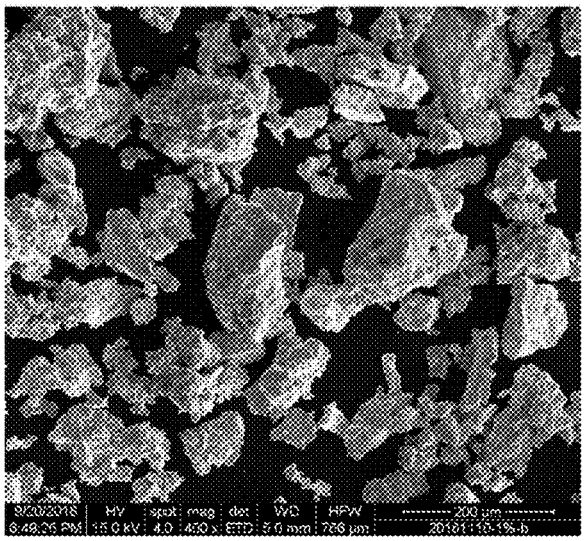
FIG. 4F is an SEM micrograph of a deoxygenated alloy powder produced in accordance with Example 2.
Figure 4G:
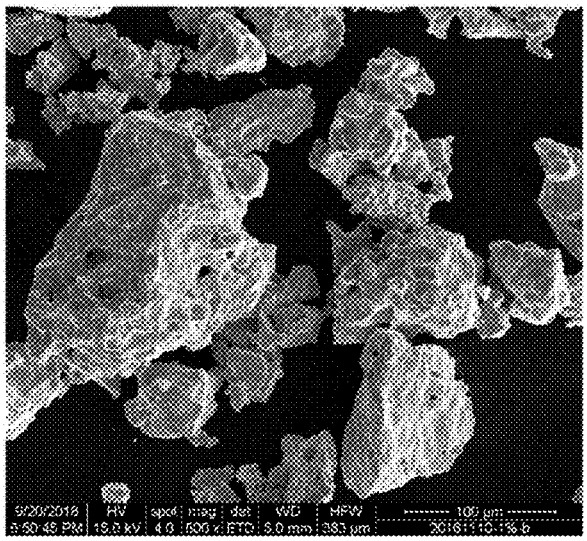
FIG. 4G is an SEM micrograph magnified from the view of FIG. 4F.

The heat treated alloy powder was then deoxygenated by mixing with Mg and $MgCl_2$ as a deoxygenation agent at a mass ratio of alloy powder:Mg:$MgCl_2$ of 1:0.2:0.3. The mixture was heated from room temperature to 740° C. under argon and then maintained at that temperature in a hydrogen atmosphere for 4 hours. Hydrogen concentration was maintained at about 1-4 wt % during cooling to produce a deoxygenated hydrogenated alloy powder as shown in FIGS. 4F and 4G. The resulting deoxygenated alloy powder was more irregular than the powder of A1 and had a mean particle size of 177.83 μm and specific surface area of 0.14 $m^2/g$. Note that the particle size and morphology remained largely consistent before and after deoxygenation. Table 3 shows the changes in oxygen content of the alloy powder at different stages of alloy production.

TABLE 3

| Oxygen content at different stages | | | |
|---|---|---|---|
| Stages | After reduction | After heat treatment | After deoxygenation |
| Oxygen % | 2.48 | 2.76 | 0.15 |

Example 3

Figure 5A:
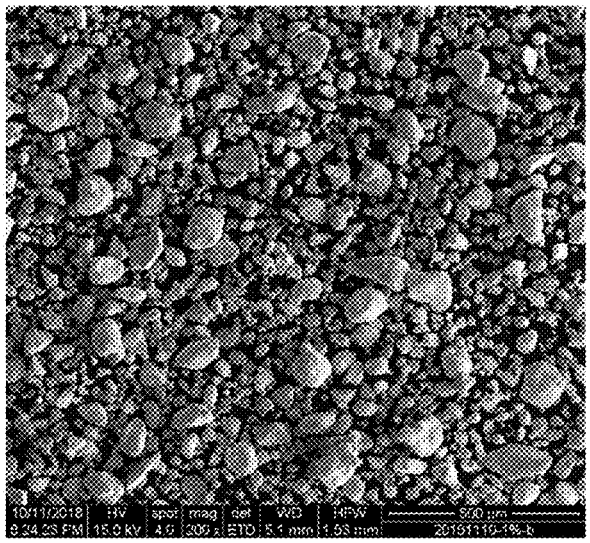
FIG. 5A is an SEM micrograph of a partially sintered composite metal oxide alloy particles in accordance with Example 3.
Figure 5B:
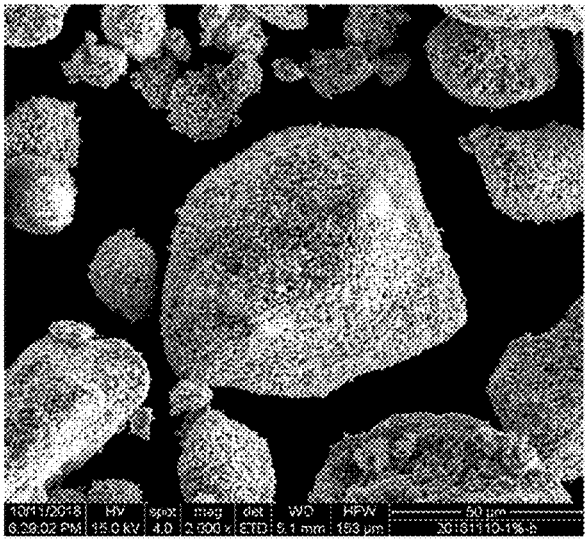
FIG. 5B is an SEM micrograph magnified from the view of FIG. 5A.

The conditions of Example 1 were largely repeated with a 10% increase in the weight of initial aluminum oxide added. The three source powders were homogenized to form a homogeneous powder mixture by mixing the composite powder into a 2 wt % PEG aqueous solution at a water to powder mass ratio of 1:1. The first batch included 600 g $TiO_2$, 49.8 g $Al_2O_3$, and 28.6 g $V_2O_5$. The mixture was then stirred for 2 hours to obtain a homogeneous mixture. The wet mixture was dried in a tray and ground to about 100 mesh. The dried material was then heated to 700° C. for about 2 hours to debind and then heated up (10° C./min) to about 1200° C. for about 4 hours to partially sinter the powder as shown in FIGS. 5A and 5B to form an agglomerated composite particle powder. The debinding and sintering step was performed under an argon atmosphere.

Figure 5C:
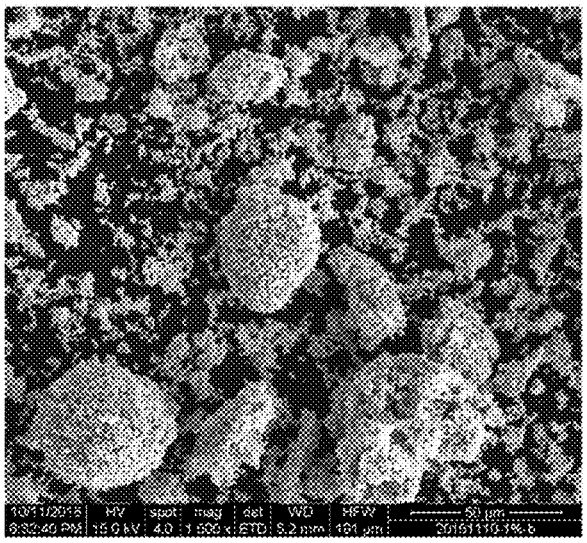
FIG. 5C is an SEM micrograph of a hydrogenated and reduced alloy powder produced in accordance with Example 3.
Figure 5D:
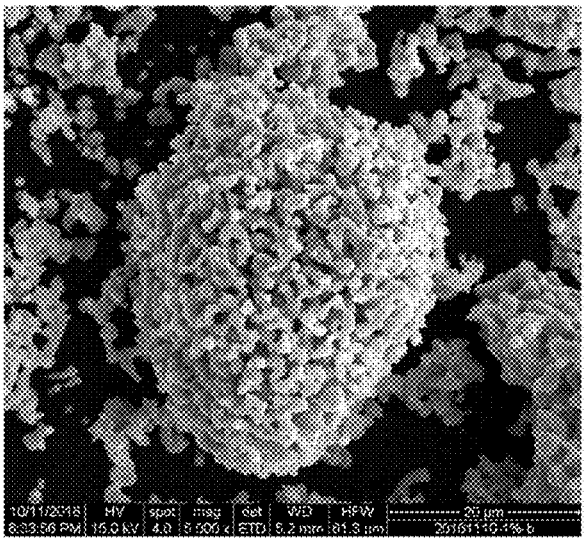
FIG. 5D is an SEM micrograph magnified from the view of FIG. 5C.

The agglomerated composite particle powder was then mixed with a mixture of Mg and $MgCl_2$ as a reducing agent and heated from room temperature under argon atmosphere to a reducing temperature of 750° C. The materials were mixed at an oxide:Mg:$MgCl_2$ mass ratio of 1:0.66:1. The argon atmosphere was then replaced with hydrogen and the temperature was maintained for 12 hours to reduce the alloy powder. The reduced alloy powder was then cooled to room temperature under a mixture of hydrogen and argon in order to maintain hydrogenation of the powder. FIGS. 5C and 5D illustrate the hydrogenated and reduced alloy powder having most of the oxides reduced and leaving a porous morphology. Oxygen content after co-reduction was 1.28 wt % (A3).

Figure 5E:
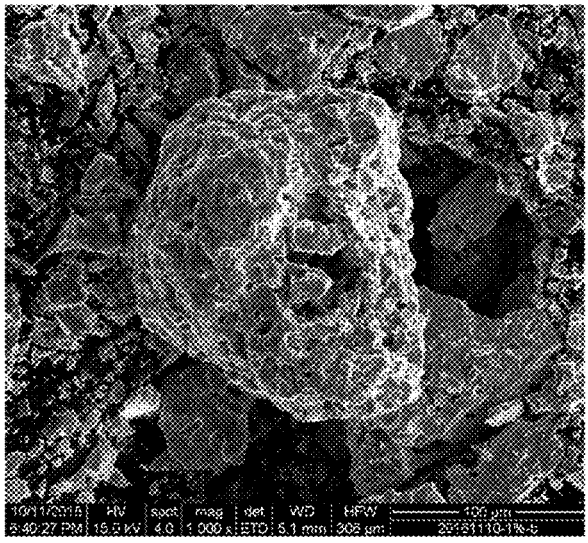
FIG. 5E is an SEM micrograph of a heat treated alloy powder produced in accordance with Example 3.
Figure 5F:
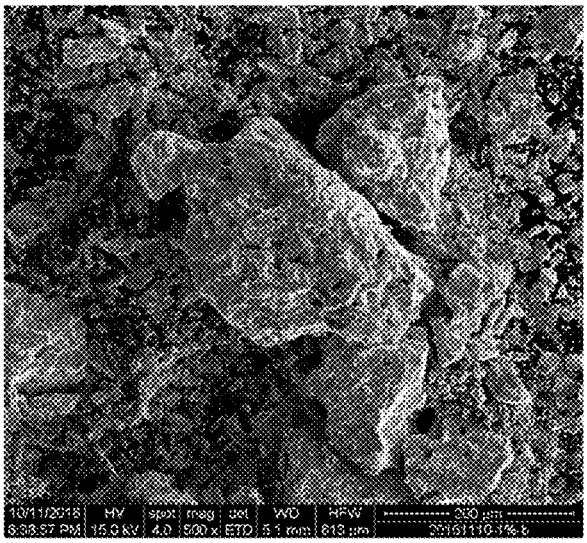
FIG. 5F is an SEM micrograph magnified from the view of FIG. 5E.

The hydrogenated and reduced alloy powder was then heated under argon from room temperature to a temperature of about 1100° C. at which point the argon was replaced with a hydrogen atmosphere and held for 3 hours as a heat treatment step to close pores. The heat treated powder was then cooled to room temperature under a mixture of argon and hydrogen. FIGS. 5E and 5F illustrate the heat treated and coarsened alloy powder. The resulting alloy powder was more difficult to crush that the powder of A1 due a modestly high dwell temperature. Thus, a lower dwell temperature and higher dwell time could be used.

Figure 5G:
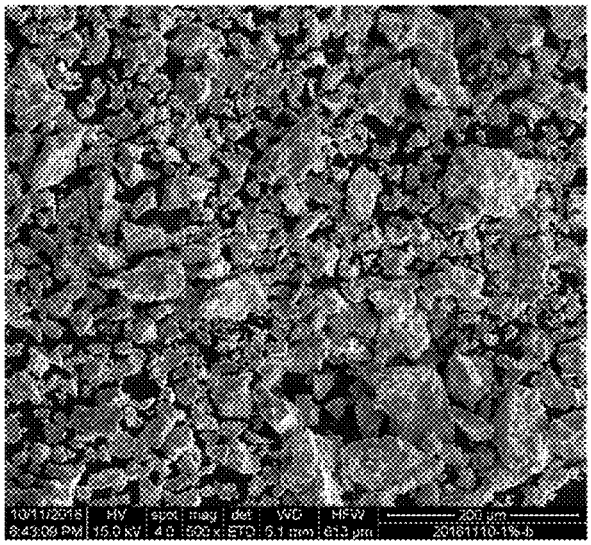
FIG. 5G is an SEM micrograph of a deoxygenated alloy powder produced in accordance with Example 3.
Figure 5H:
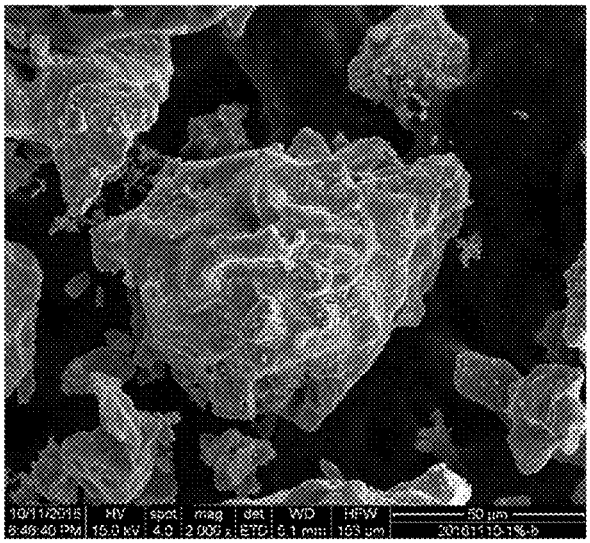
FIG. 5H is an SEM micrograph magnified from the view of FIG. 5G.

The heat treated alloy powder was then deoxygenated by mixing with Mg and $MgCl_2$ as a deoxygenation agent at a mass ratio of alloy powder:Mg:$MgCl_2$ of 1:0.2:0.3. The mixture was heated from room temperature to 740° C. under argon and then maintained at that temperature in a hydrogen atmosphere for 4 hours. Hydrogen concentration was maintained at about 1-4 wt % during cooling to produce a deoxygenated hydrogenated alloy powder as shown in FIGS. 5G and 5H. The resulting deoxygenated alloy powder was more irregular than the powder of A1 and had a mean particle size of 145.32 μm and BET surface area of 0.16 $m^2/g$. Note that the particle size and morphology remained largely consistent before and after deoxygenation. Table 4 shows the changes in oxygen content of the alloy powder at different stages of alloy production.

TABLE 4

| Oxygen content at different stages | | | |
|---|---|---|---|
| Stages | After reduction | After heat treatment | After deoxygenation |
| Oxygen % | 1.28 | 1.34 | 0.15 |

Example 4

The same basic process as in Example 1 was repeated again, except using $V_2O_3$ as the vanadium oxide source powder instead of $V_2O_5$. $V_2O_5$ powder was milled to less than 1 μm and heated under a hydrogen atmosphere at 600° C. for 3 hours in a first stage and then 900° C. for 5 hours in a second stage. An initial 40 g of $V_2O_5$ was pre-reduced to 31.85 g of $V_2O_3$ powder.

Figure 6A:
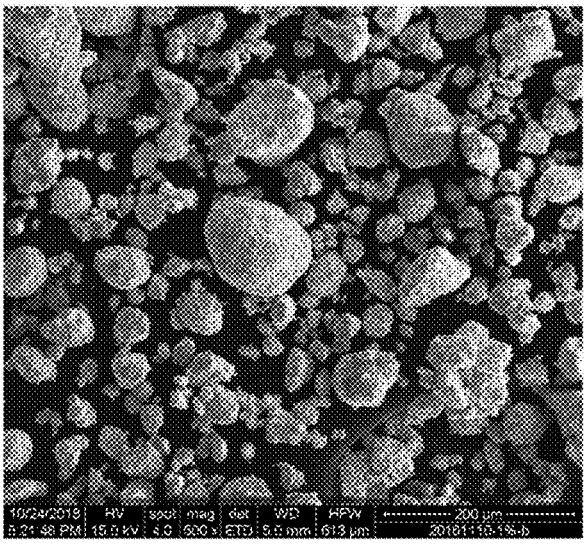
FIG. 6A is an SEM micrograph of a partially sintered composite metal oxide alloy particles in accordance with Example 4.
Figure 6B:
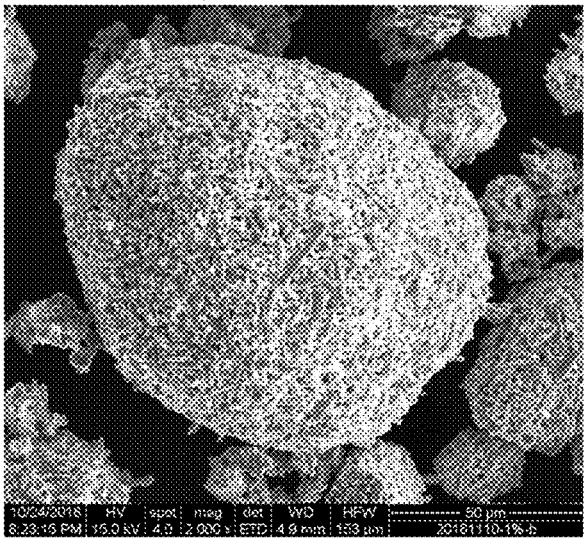
FIG. 6B is an SEM micrograph magnified from the view of FIG. 6A.

The three source powders were homogenized to form a homogeneous powder mixture by mixing the composite powder into a 2 wt % PEG aqueous solution at a water to powder mass ratio of 1:1. The first batch included 600 g $TiO_2$, 45.3 g $Al_2O_3$, and 28.6 g $V_2O_3$. The mixture was then stirred for 2 hours to obtain a homogeneous mixture. The wet mixture was dried in a tray and ground to about 100 mesh. The dried material was then heated to 700° C. for about 2 hours to debind and then heated up (10° C./min) to about 1200° C. for about 4 hours to partially sinter the powder as shown in FIGS. 6A and 6B to form an agglomerated composite particle powder. The debinding and sintering step was performed under an argon atmosphere.

Figure 6C:
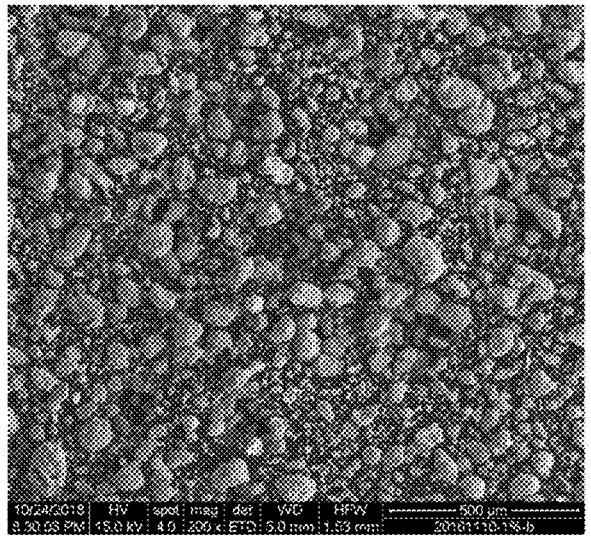
FIG. 6C is an SEM micrograph of a hydrogenated and reduced alloy powder produced in accordance with Example 4.
Figure 6D:
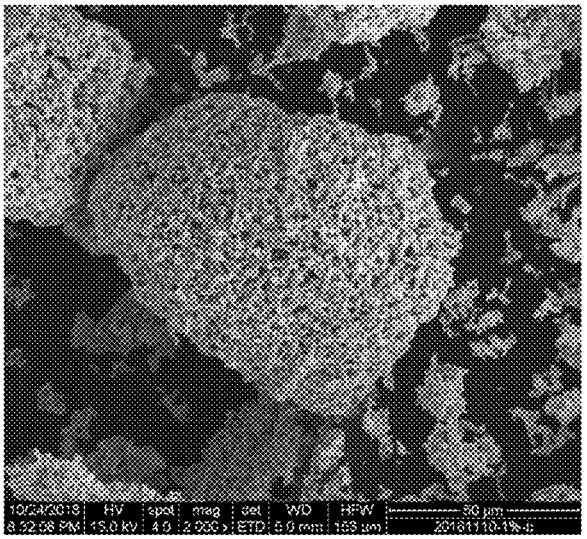
FIG. 6D is an SEM micrograph magnified from the view of FIG. 6C.

The agglomerated composite particle powder was then mixed with a mixture of Mg and $MgCl_2$ as a reducing agent and heated from room temperature under argon atmosphere to a reducing temperature of 750° C. The materials were mixed at an oxide:Mg:$MgCl_2$ mass ratio of 1:0.66:1. The argon atmosphere was then replaced with hydrogen and the temperature was maintained for 12 hours to reduce the alloy powder. The reduced alloy powder was then cooled to room temperature under a mixture of hydrogen and argon in order to maintain hydrogenation of the powder. FIGS. 6C and 6D illustrate the hydrogenated and reduced alloy powder having most of the oxides reduced and leaving a porous morphology. Oxygen content after co-reduction was 1.16 wt % (A4).

Figure 6E:
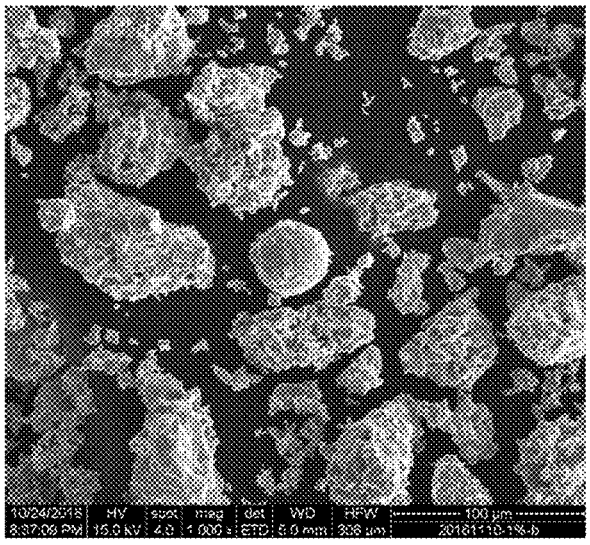
FIG. 6E is an SEM micrograph of a heat treated alloy powder produced in accordance with Example 4.
Figure 6F:
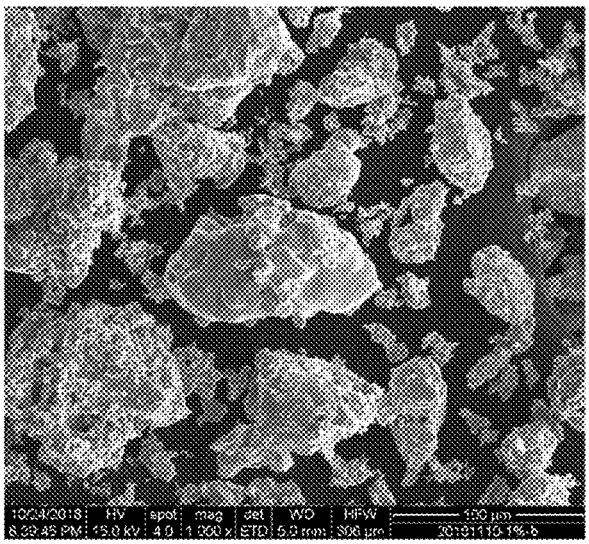
FIG. 6F is an SEM micrograph magnified from the view of FIG. 6E.

The hydrogenated and reduced alloy powder was then heated under argon from room temperature to a temperature of about 1100° C. at which point the argon was replaced with a hydrogen atmosphere and held for 2 hours as a heat treatment step to close pores. The heat treated powder was then cooled to room temperature under a mixture of argon and hydrogen. FIGS. 6E and 6F illustrate the heat treated and coarsened alloy powder. The resulting alloy powder was easier to crush that the powder of A2.

The heat treated alloy powder was then deoxygenated by mixing with Mg and $MgCl_2$ as a deoxygenation agent at a mass ratio of alloy powder:Mg:$MgCl_2$ of 1:0.2:0.3. The mixture was heated from room temperature to 740° C. under argon and then maintained at that temperature in a hydrogen atmosphere for 10 hours. Hydrogen concentration was maintained at about 1-4 wt % during cooling to produce a deoxygenated hydrogenated alloy powder. The resulting deoxygenated alloy powder had a final oxygen content of 0.15 wt %, 6.88 aluminum %, and 4.82 vanadium % which aligns closely with commercial specifications for Ti-6Al-4V.

Example 5

Figure 7A:
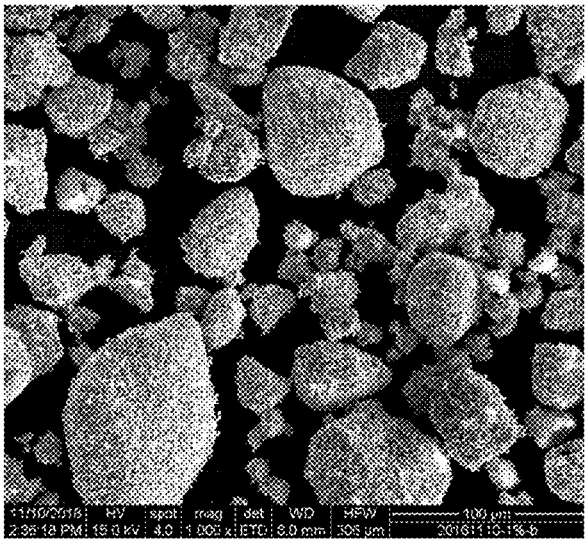
FIG. 7A is an SEM micrograph of a partially sintered composite metal oxide alloy particles in accordance with Example 5 (A5).
Figure 7B:
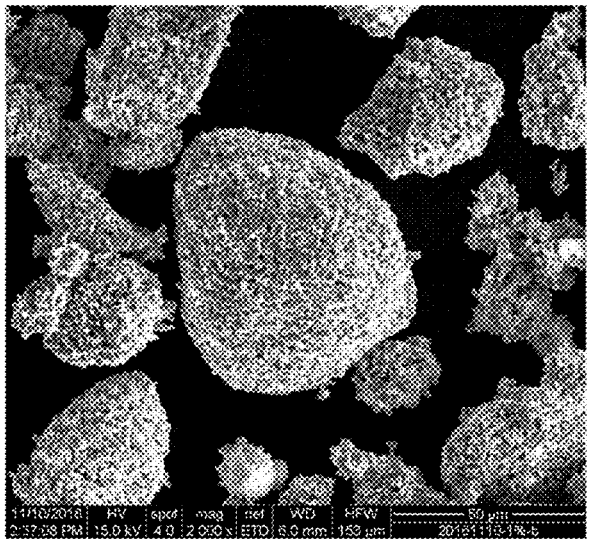
FIG. 7B is an SEM micrograph magnified from the view of FIG. 7A.
Figure 7C:
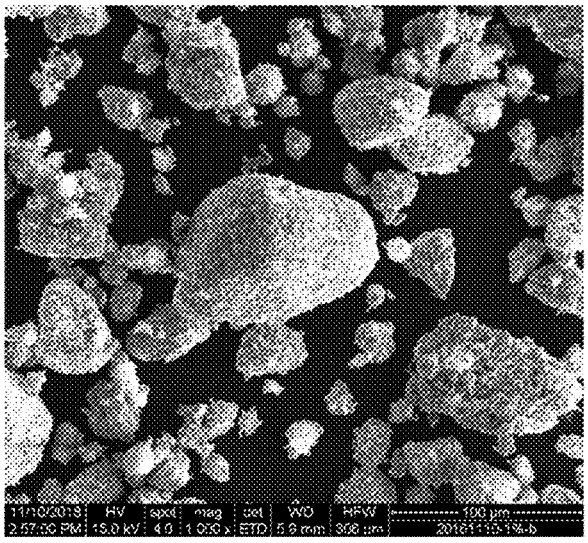
FIG. 7C is an SEM micrograph of a partially sintered composite metal oxide alloy particles in accordance with Example 5 (A6).
Figure 7D:
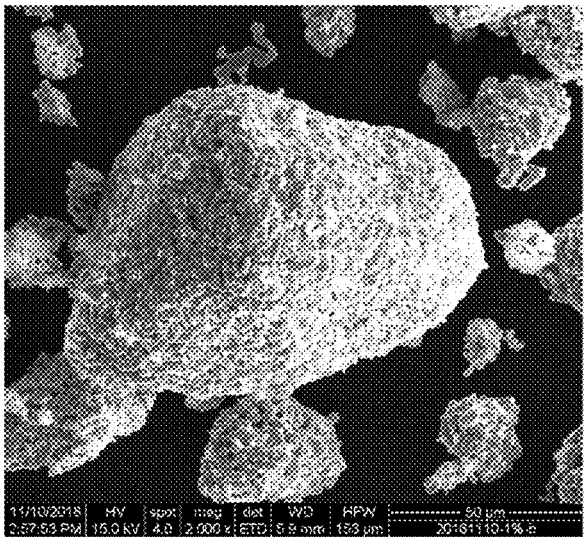
FIG. 7D is an SEM micrograph magnified from the view of FIG. 7C.

The conditions of Example 4 were repeated except pre-reduction of $V_2O_5$ included a first stage at 600° C. for 3 hours and a second stage at 900° C. for 5 hours. Debinding and sintering were also performed as in Example 4, except a first batch (A5) was cooled under hydrogen and a second batch (A6) was cooled under air. FIGS. 7A and 7B show sample A5 after sintering. FIGS. 7C and 7D show sample A6 after sintering.

Figure 7E:
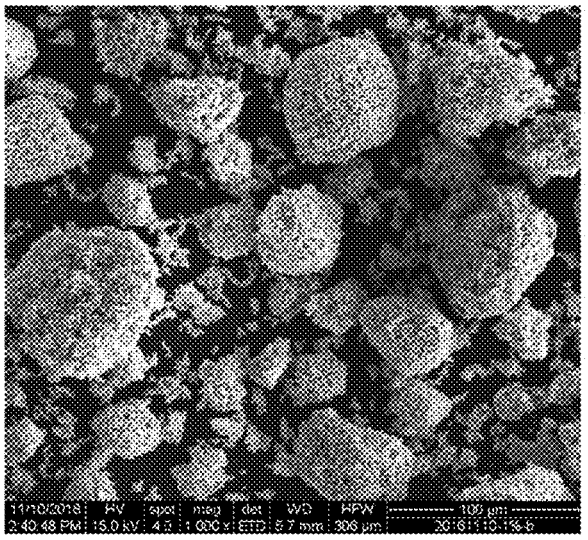
FIG. 7E is an SEM micrograph of sample A5 subsequent to co-reduction in accordance with Example 5.
Figure 7F:
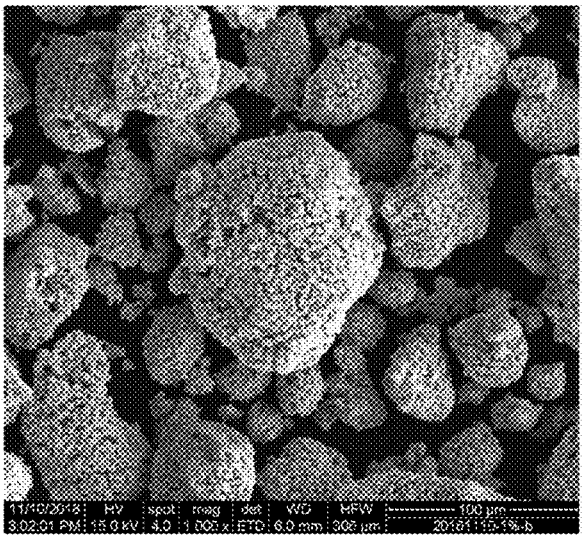
FIG. 7F is an SEM micrograph of sample A6 subsequent to co-reduction in accordance with Example 5.

The powders were co-reduced as in Example 4. FIG. 7E shows the co-reduction results of A5 having an oxygen content of 2.08%. FIG. 7F shows the co-reduction results of A6 having an oxygen content of 5.04%.

Figure 7G:
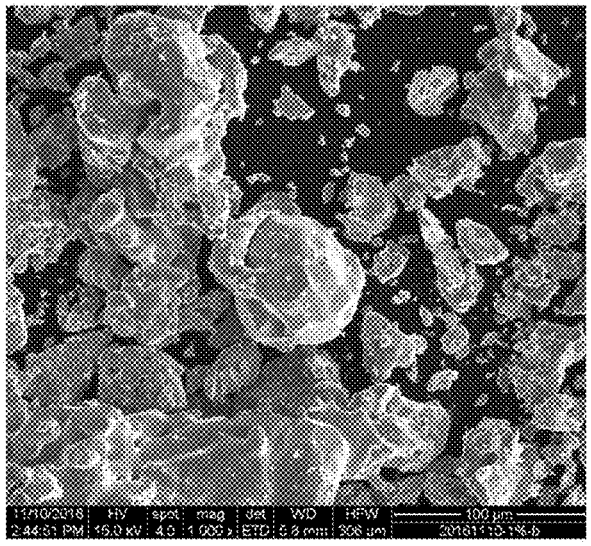
FIG. 7G is an SEM micrograph of sample A5 subsequent to heat treatment in accordance with Example 5.
Figure 7H:
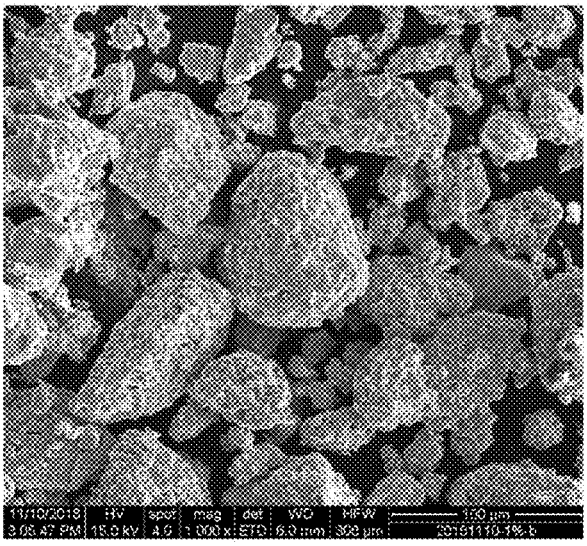
FIG. 7H is an SEM micrograph of sample A6 subsequent to heat treatment in accordance with Example 5.
Figure 7I:
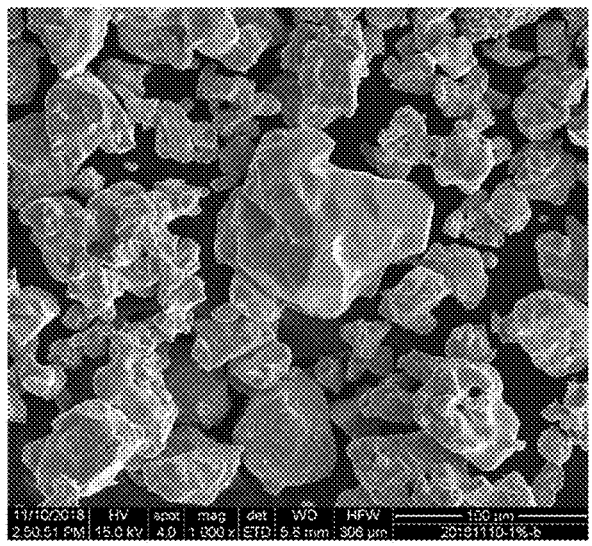
FIG. 7I is an SEM micrograph of sample A5 subsequent to deoxygenation in accordance with Example 5.
Figure 7J:
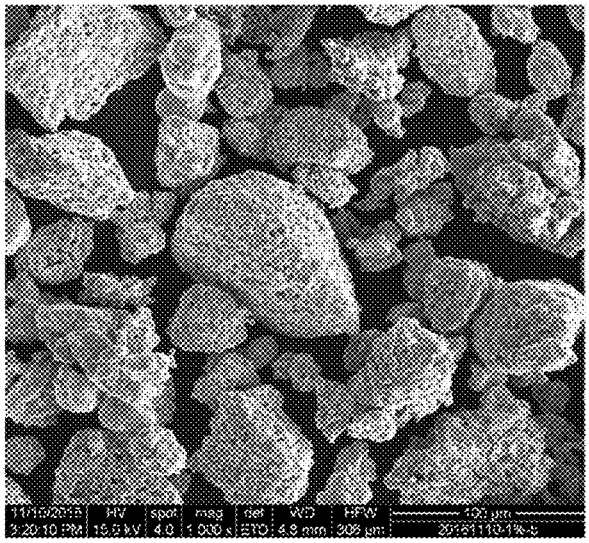
FIG. 7J is an SEM micrograph of sample A6 subsequent to deoxygenation in accordance with Example 5.

The reduced powder was then heat treated as in Example 4 with results for A5 and A6 shown in FIGS. 7G and 7H, respectively. These powders were then subjected to deoxygenation as in Example 4. FIGS. 7I and 7J illustrate the deoxygenated powders. The deoxygenated alloy powders of A5 had an oxygen content of 0.087 wt %, while the powders of A6 had an oxygen content of 0.25 wt %. The deoxygenated alloy powder of A5 had a mean particle size of 102.32 μm and specific surface area of 0.11 $m^2/g$. The deoxygenated alloy powder of A6 had a mean particle size of 74.17 μm and BET surface area of 0.35 $m^2/g$. EDS results also showed that Al and V content in each of A5 and A6 were reasonably close to targets (i.e. 7.57 wt % and 7.66 wt % for Al and 4.36 wt % and 4.11 wt % for V), with aluminum being higher than the target 6 wt %.

Comparison

Table 5 shows the oxygen content as a function of BET surface area for different batches. The results show that oxygen content after deoxygenation in Ti-6Al-4V alloys increases with the increase of BET surface area. These results also indicate that oxygen attached on the surface of particles contributes most to the overall oxygen content. The specific surface area can be kept <0.15 $m^2/g$ at least to guarantee the oxygen content after deoxygenation reaches the ASTM B299 standard (<0.15 wt %).

TABLE 5

Oxygen content vs. BET surface area for different batches

| Batch No. | A1 | A2 | A3 | A4 | A5 |
|---|---|---|---|---|---|
| Specific surface area ($m^2/g$) | 0.21 | 0.14 | 0.16 | 0.16 | 0.11 |
| Oxygen content (wt %) | 0.26 | 0.15 | 0.15 | 0.15 | 0.087 |

The heat treatment step appears to significantly influence specific surface area. In this step, particles are activated to close pores by heat. Higher temperature and longer holding time are both effective on closing pores. However, high temperature and long holding time can also cause caking and make the powders harder to break apart. In order to solve this problem, hydrogen was applied during cooling to form TiH, which is relatively easy to break apart at room temperature.

A review of SEM images at different stages showed Al rich areas and V rich areas were observed clearly after de-binding and sintering of Ti, Al, and V oxides. After reduction, element distribution was more uniform for both alloying elements. However, the Al and V rich areas could hardly be seen after heat treatment and deoxygenation, which indicates that homogenization of elements occurred throughout the alloy production process. Similarly, a line scan was performed on a cross-section of the Ti-6Al-4V alloy powder after deoxygenation. The line scans showed similar trends for each of the three elements as being uniformly distributed in alloy particles. Energy dispersive x-ray spectroscopy (EDS) was also performed on the deoxygenated samples A1, A2, and A3. Spectra from a cross section of Ti-6Al-4V standard sample were measured and ten particles were chosen for analysis and the variation from particle to particle was determined. The results show the variation from particle to particle is within 0.8 for Al and 0.46 for V. The measured results for Al and V content were 7.34% and 3.76% separately, which is different from the given composition analyzed by ICP. Thus, compared with the given composition, +13.2% off for Al and −4.0% off for V was applied to the measured samples.

In this experiment, theoretical amounts of Al (6%) and V (4%) was added for A1, 10% more aluminum is added for A2 and A3 as contrast. Results of EDS analysis is provided in Table 6.

TABLE 6

EDS aluminum and vanadium content

| Sample | Al (calibrated %) | V (calibrated %) |
|---|---|---|
| A1 | 6.15 | 3.04 |
| A2 | 6.80 | 3.10 |
| A3 | 6.9 | 3.14 |
| Standard (ASM4998) | 5.5-6.5 | 3.5-4.5 |

The results show calibrated aluminum for A1 is 6.15%, which is in the acceptable range. However, calibrated A2 and A3 both contain more aluminum than the acceptable upper limit. Thus, the theoretical value of $Al_2O_3$ can be added with good results. Variation of A1 and V is in the acceptable range from particle to particle in the same batch, for all batches from A1-A3 indicating good uniformity.

The results also indicate that all three samples contain less vanadium than the desired lower limit. Accordingly, as described above, examples A4 to A6 were processed using $V_2O_3$ as the vanadium oxide source powder at stoichiometric ratios. $V_2O_3$ has a higher melting point (1970° C.) than $V_2O_5$ (690° C.) which may reduce evaporation during debinding and sintering at 1200° C. Table 7 shows the EDS results for samples A4 to A6.

TABLE 7

EDS aluminum and vanadium content

| Sample | Al (calibrated %) | V (calibrated %) |
|---|---|---|
| A4 | 6.04 | 3.66 |
| A5 | 6.21 | 3.45 |
| A6 | 6.11 | 4.11 |
| Standard (ASM4998) | 5.5-6.5 | 3.5-4.5 |

These results showed both aluminum and vanadium within acceptable ranges. However, particle to particle variation of vanadium within each batch was unacceptably high. This would appear to be the result of poor wettability of $V_2O_3$ compared to $V_2O_5$ resulting in inhomogeneous distribution of elements among particles. Thus, a 20% to 30% excess of $V_2O_5$ can be used in the composite powder to achieve good wettability and allow for some evaporation or loss during pre-reduction steps. In some cases, an excess of 10% to 50% can also be suitable.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A method for producing a particulate titanium alloy product, comprising:

preparing a composite particulate oxide mixture including titanium oxide powder and at least one alloying element powder, wherein the at least one alloying element powder is at least one of a metal oxide powder, an elemental metal, and a metal hydride, further wherein the metal oxide powder is selected from the group consisting of $Al_2O_3$, $V_2O_5$, CuO, MnO, $V_2O_3$, $Fe_2O_3$, $Nb_2O_5$, $ZrO_2$, $MoO_3$, $MoO_2$, $Cr_2O_3$, $SnO_2$, $SiO_2$, $Ta_2O_5$, CoO, $WO_3$, NiO, and combinations thereof, wherein the elemental metal is selected from the group consisting of Al, Mo, V, Nb, Ta, Fe, Cr, Mn, Co, Cu, W, Zr, Sn, Ni, Si and combinations thereof; and wherein the metal hydride is selected from the group consisting of aluminum hydride, vanadium hydride, niobium hydride, tantalum hydride, zirconium hydride, silicon hydride, and combinations thereof;

co-reducing the composite particulate oxide mixture using a metallic reducing agent under a hydrogen atmosphere at a reduction temperature for a reduction time sufficient to produce a hydrogenated titanium alloy product;

heat treating the hydrogenated titanium alloy product under a hydrogen atmosphere and a heat treating temperature to reduce pore size and specific surface area to form a heat treated hydrogenated titanium product;

deoxygenating the heat treated hydrogenated titanium product to reduce residual oxygen to less than 0.3 wt % to form a deoxygenated hydrogenated titanium product; and optionally dehydrogenating the deoxygenated hydrogenated titanium product to form the titanium alloy product, wherein the deoxygenated hydrogenated titanium product and the titanium alloy product are a particulate.

2. The method of claim 1, wherein the titanium oxide powder is greater than 80 wt % titanium oxides.

3. The method of claim 1, wherein the composite particulate oxide mixture is prepared by:

milling the titanium oxide powder and the at least one alloying element powder to form an oxide feed powder having a target particle size;

homogenizing the oxide feed powder to form a composite homogeneous agglomeration;

drying and grinding the composite homogeneous agglomeration to form a homogenized composite oxide powder; and debinding and sintering the homogenized composite oxide powder to form a sintered composite oxide material; and crushing the sintered composite oxide material to form a sintered homogenized composite oxide powder having a magnified particulate size with respect to the target particle size.

4. The method of claim 1, wherein the titanium product is selected from the group consisting of Ti-6Al-4V, Ti-2.5Cu, Ti-8Mn, Ti-3Al-2.5V, Ti-5Al-2.5Fe, Ti-6Al-7Nb, Ti-13Nb-13Zr, Ti-15Mo-5Zr, Ti-10V-2Fe-3Al, Ti-8V-3Al-6Cr-4Mo-4Zr, Ti-6Al-2 Sn-4Zr-2Mo-0.1Si, Ti-15Mo-3Al-2.7Nb-0.25Si, and Ti-15Mo-2Sn-4Zr-4Mo-2Cr-1Fe.

5. The method of claim 1, wherein the metallic reducing agent is at least one of a magnesium reducing agent and a calcium reducing agent.

6. The method of claim 1, wherein the co-reduction further includes a molten salt medium wherein the reducing temperature is sufficient to melt both the metallic reducing agent and the molten salt medium.

7. The method of claim 6, wherein the metallic reducing agent is Mg and the molten salt medium is $MgCl_2$.

8. The method of claim 1, wherein the co-reduction is performed by heating to the reducing temperature under an inert gas and then introducing the hydrogen atmosphere within about 10% of reaching the reducing temperature.

9. The method of claim 8, wherein the co-reduction includes a cooling stage in which a hydrogen atmosphere is maintained, and inert gas is optionally included.

10. The method of claim 1, wherein an oxygen content of the hydrogenated titanium alloy product is less than about 0.2%.

11. The method of claim 1, wherein the hydrogenated titanium alloy product includes $TiH_2$ with alloying elements dissolved within, and optionally elemental titanium.

12. The method of claim 1, wherein the method excludes electrolysis and chlorination.

13. The method of claim 1, wherein the hydrogenated titanium alloy product is a particulate having a specific surface area from 0.1 $m^2/g$ to 100 $m^2/g$, and an average particle diameter from 1 μm to 1000 μm.

14. The method of claim 1, wherein the heat treated hydrogenated titanium product is a densified and coarsened particulate having a small specific surface area from 0.01 $m^2/g$ to 0.5 $m^2/g$, and an average particle diameter from 1 μm to 1000 μm.

15. The method of claim 1, further comprising crushing the heat treated hydrogenated titanium product to reduce agglomeration and form a particulate powder having an average particle size from 10 μm to 1000 μm.

16. The method of claim 1, wherein the deoxygenating is accomplished by heating the heat treated hydrogenated titanium product with a deoxygenation agent at a deoxygenation temperature and under a hydrogen atmosphere.

17. The method of claim 16, wherein the deoxygenation agent is at least one of Mg, $MgH_2$, Ca, and $CaH_2$.

18. The method of claim 17, wherein the deoxygenation agent is Mg and $MgCl_2$ is used as a molten salt medium.

19. The method of claim 16, wherein the mass ratio of the heat treated hydrogenated titanium product to deoxygenation agent is 1:0.2 to 1:1.

20. The method of claim 16, wherein the deoxygenation temperature is sufficient to melt the agent, and it is also sufficient to melt the salt in the mixture.

21. The method of claim 16, wherein the deoxygenation is performed by heating the heat treated hydrogenated titanium product under an inert gas atmosphere to within about 20% of the deoxygenation temperature, and then maintaining the hydrogen atmosphere during a dwell time of deoxygenation.

22. The method of claim 16, further comprising removing residual metallic reducing agent and respective reducing agent oxides from the hydrogenated titanium alloy product or the heat treated hydrogenated titanium product prior to deoxygenating.

23. The method of claim 16, wherein the deoxygenation temperature is from 650° C. to 800° C.

24. The method of claim 1, wherein the residual oxygen in the deoxygenated hydrogenated titanium product is less than 0.15 wt %.

25. The method of claim 1, wherein the dehydrogenating is not optional and the dehydrogenating comprises heating the deoxygenated hydrogenated titanium product in a hydrogen deficient atmosphere sufficient to drive hydrogen out from the deoxygenated hydrogenated titanium product to form the titanium alloy product having a hydrogen content less than about 100 ppm wt %.

26. A method for producing a particulate titanium alloy product, comprising:

preparing a particulate oxide mixture including titanium oxide powder;

reducing the particulate oxide mixture using a metallic reducing agent under a hydrogen atmosphere at a reduction temperature for a reduction time sufficient to produce a hydrogenated titanium product;

introducing at least one alloying element to the hydrogenated titanium product to form a composite hydrogenated titanium product, wherein the at least one alloying element powder is at least one of a metal oxide powder, an elemental metal, and a metal hydride, further wherein the metal oxide powder is selected from the group consisting of $Al_2O_3$, $V_2O_5$, CuO, MnO, $V_2O_3$, $Fe_2O_3$, $Nb_2O_5$, $ZrO_2$, $MoO_3$, $MoO_2$, $Cr_2O_3$, $SnO_2$, $SiO_2$, $Ta_2O$, CoO, $WO_3$, NiO, and combinations thereof, wherein the elemental metal is selected from the group consisting of Al, Mo, V, Nb, Ta, Fe, Cr, Mn, Co, Cu, W, Zr, Sn, Ni, Si and combinations thereof; and wherein the metal hydride is selected from the group consisting of aluminum hydride, vanadium hydride, niobium hydride, tantalum hydride, zirconium hydride, silicon hydride, and combinations thereof;

heat treating the composite hydrogenated titanium product under a hydrogen atmosphere and a heat treating temperature to reduce pore size and specific surface area to form a heat treated hydrogenated titanium alloy product;

deoxygenating the heat treated hydrogenated titanium alloy product to reduce residual oxygen to less than 0.3 wt % to form a deoxygenated hydrogenated titanium product; and optionally dehydrogenating the deoxygenated hydrogenated titanium product to form the titanium alloy product, wherein the deoxygenated hydrogenated titanium product and the titanium alloy product are a particulate.

27. The method of claim 26, wherein the at least one alloying element powder is an elemental metal and the steps of introducing and heat treating are performed simultaneously.

28. A method for producing a particulate titanium alloy product, comprising:

preparing a composite particulate oxide mixture including titanium oxide powder and at least one alloying element powder;

co-reducing the composite particulate oxide mixture using a metallic reducing agent under a hydrogen atmosphere at a reduction temperature for a reduction time sufficient to produce a hydrogenated titanium alloy product, wherein the co-reduction is performed by heating to the reducing temperature under an inert gas and then introducing the hydrogen atmosphere within about 10% of reaching the reducing temperature;

heat treating the hydrogenated titanium alloy product under a hydrogen atmosphere and a heat treating temperature to reduce pore size and specific surface area to form a heat treated hydrogenated titanium product;

deoxygenating the heat treated hydrogenated titanium product to reduce residual oxygen to less than 0.3 wt % to form a deoxygenated hydrogenated titanium product; and optionally dehydrogenating the deoxygenated hydrogenated titanium product to form the titanium alloy product, wherein the deoxygenated hydrogenated titanium product and the titanium alloy product are a particulate.

29. The method of claim 28, wherein the at least one alloying element powder is at least one of a metal oxide powder, an elemental metal, and a metal hydride, further wherein the metal oxide powder is selected from the group consisting of $Al_2O_3$, $V_2O_5$, CuO, MnO, $V_2O_3$, $Fe_2O_3$, $Nb_2O_5$, $ZrO_2$, $MoO_3$, $MoO_2$, $Cr_2O_3$, $SnO_2$, $SiO_2$, $Ta_2O_5$, CoO, $WO_3$, NiO, and combinations thereof, wherein the elemental metal is selected from the group consisting of Al, Mo, V, Nb, Ta, Fe, Cr, Mn, Co, Cu, W, Zr, Sn, Ni, Si and combinations thereof; and wherein the metal hydride is selected from the group consisting of aluminum hydride, vanadium hydride, niobium hydride, tantalum hydride, zirconium hydride, silicon hydride, and combinations thereof.

30. A method for producing a particulate titanium alloy product, comprising:

preparing a composite particulate oxide mixture including titanium oxide powder and at least one alloying element powder;

co-reducing the composite particulate oxide mixture using a metallic reducing agent under a hydrogen atmosphere at a reduction temperature for a reduction time sufficient to produce a hydrogenated titanium alloy product;

heat treating the hydrogenated titanium alloy product under a hydrogen atmosphere and a heat treating temperature to reduce pore size and specific surface area to form a heat treated hydrogenated titanium product;

deoxygenating the heat treated hydrogenated titanium product to reduce residual oxygen to less than 0.3 wt % to form a deoxygenated hydrogenated titanium product, wherein the deoxygenating is accomplished by heating the heat treated hydrogenated titanium product with a deoxygenation agent at a deoxygenation temperature and under a hydrogen atmosphere, and wherein the deoxygenation is performed by heating the heat treated hydrogenated titanium product under an inert gas atmosphere to within about 20% of the deoxygenation temperature, and then maintaining the hydrogen atmosphere during a dwell time of deoxygenation; and optionally dehydrogenating the deoxygenated hydrogenated titanium product to form the titanium alloy product, wherein the deoxygenated hydrogenated titanium product and the titanium alloy product are a particulate.

* * * * *